US011522299B2

(12) United States Patent
Park et al.

(10) Patent No.: US 11,522,299 B2
(45) Date of Patent: Dec. 6, 2022

(54) ANTENNA FORMED BY OVERLAPPING ANTENNA ELEMENTS TRANSMITTING AND RECEIVING MULTI-BAND SIGNAL AND ELECTRONIC DEVICE INCLUDING THE SAME

(71) Applicant: Samsung Electronics Co., Ltd., Gyeonggi-do (KR)

(72) Inventors: Sungchul Park, Gyeonggi-do (KR); Sumin Yun, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 279 days.

(21) Appl. No.: 16/654,265

(22) Filed: Oct. 16, 2019

(65) Prior Publication Data

US 2020/0127387 A1 Apr. 23, 2020

(30) Foreign Application Priority Data

Oct. 23, 2018 (KR) ..... 10-2018-0126603

(51) Int. Cl.
*H01Q 21/06* (2006.01)
*H01Q 21/00* (2006.01)
(Continued)

(52) U.S. Cl.
CPC ..... *H01Q 21/065* (2013.01); *H01Q 1/246* (2013.01); *H01Q 5/10* (2015.01); *H01Q 9/045* (2013.01);
(Continued)

(58) Field of Classification Search
CPC ..... H01Q 21/065; H01Q 21/26; H01Q 21/30; H01Q 9/0414; H01Q 9/045; H01Q 21/24; H01Q 9/0407; H01Q 1/38
See application file for complete search history.

(56) References Cited

U.S. PATENT DOCUMENTS 5,497,164 A * 3/1996 Croq ..... H01Q 19/005 343/846
6,121,931 A 9/2000 Levi
(Continued)

FOREIGN PATENT DOCUMENTS

EP 2 339 693 A1 6/2011
JP 2003-309424 A 10/2003
(Continued)

OTHER PUBLICATIONS

International Search Report dated Feb. 14, 2020.
European Search Report dated Jul. 20, 2021.

*Primary Examiner* — Ricardo I Magallanes
(74) *Attorney, Agent, or Firm* — Cha & Reiter, LLC

(57) ABSTRACT

Presented herein is an electronic device comprising a Printed Circuit Board (PCB) including a first circuit board plane including a plurality of first patch antenna elements and a second circuit board plane including a plurality of second patch antenna elements, a communication module that transmits and receives a signal of a first frequency band using the plurality of first patch antenna elements, and transmits and receives a signal of a second frequency band higher than the first frequency band using the plurality of second patch antenna elements, a processor connected to the communication module, wherein central points of the plurality of first patch antenna elements are spaced apart from one another to have a first distance and central points of the plurality of second patch antenna elements are spaced apart from one another to have a second distance shorter than the first distance, and wherein the plurality of second patch antenna elements are arranged such that the central points of the plurality of second patch antenna elements are disposed to be closer to a central axis connecting a first central point that is a center of gravity of the first circuit board plane and a second central point that is a center of gravity of the second
(Continued)

circuit board plane in a direction passing through the printed circuit board from a first surface to a second surface of the printed circuit board, than central points of the plurality of first patch antenna elements.

20 Claims, 11 Drawing Sheets

(51) Int. Cl.
*H01Q 5/10* (2015.01)
*H01Q 9/04* (2006.01)
*H01Q 9/30* (2006.01)
*H01Q 1/24* (2006.01)

(52) U.S. Cl.
CPC ..... *H01Q 9/0414* (2013.01); *H01Q 9/30* (2013.01); *H01Q 21/0075* (2013.01)

(56) References Cited

U.S. PATENT DOCUMENTS 7,202,818 B2 4/2007 Anguera Pros et al.
9,214,739 B2 12/2015 Sover et al.
9,698,487 B2 7/2017 Sudo et al.
2002/0014995 A1* 2/2002 Roberts ..... H01Q 9/0442 343/700 MS
2005/0190106 A1 9/2005 Anguera Pros et al.
2007/0200760 A1* 8/2007 Hjelmstad ..... H01Q 15/147 342/417
2008/0036676 A1* 2/2008 Puente Baliarda ..... H01Q 5/42 343/844
2012/0280880 A1* 11/2012 Arvidsson ..... H01Q 1/246 343/810
2013/0099006 A1* 4/2013 Hong ..... H01Q 1/2283 235/492
2015/0325928 A1 11/2015 Chao
2017/0256867 A1 9/2017 Ding et al.
2017/0302395 A1* 10/2017 Ashrafi ..... H01Q 25/04
2020/0106183 A1* 4/2020 Fabrega Sanchez ..... H04B 1/0458
2020/0136234 A1* 4/2020 Paulotto ..... H01Q 15/0026

FOREIGN PATENT DOCUMENTS

JP 2006-13831 A 1/2006
KR 10-1744605 B1 6/2017

* cited by examiner

ANTENNA FORMED BY OVERLAPPING ANTENNA ELEMENTS TRANSMITTING AND RECEIVING MULTI-BAND SIGNAL AND ELECTRONIC DEVICE INCLUDING THE SAME

CROSS-REFERENCE TO RELATED APPLICATION(S)

This application is based on and claims priority under 35 U.S.C. § 119 to Korean Patent Application No. 10-2018-0126603, filed on Oct. 23, 2018, in the Korean intellectual Property Office, the disclosure of which is incorporated by reference herein its entirety.

BACKGROUND

1. Field

Embodiments disclosed in the disclosure relate to technique(s) for providing an antenna structure that may be capable of increasing a bandwidth to transmit signals in a plurality of frequency bands and isolating signals of different frequencies from each other.

2. Description of Related Art

An electronic device (e.g., a smartphone or a wearable device) that supports wireless communication transmits and receives radio frequency (RF) signals. The printed circuit board (PCB) of the electronic device may have one or more circuit board layers. The electronic device transmits and receives an RF signal using a plurality of patch antenna elements provided on the circuit board layers. When the electronic device receives the RF signal by the plurality of patch antenna elements, the communication module provides the information content of the RF signal to a processor.

The above information is presented as background information only to assist with an understanding of the disclosure. No determination has been made, and no assertion is made, as to whether any of the above might be applicable as prior art with regard to the disclosure.

SUMMARY

In accordance with an aspect of the disclosure, an electronic device comprising a Printed Circuit Board (PCB) including a first circuit board plane including a plurality of first patch antenna elements and a second circuit board plane including a plurality of second patch antenna elements, a communication module that transmits and receives a signal of a first frequency band using the plurality of first patch antenna elements, and transmits and receives a signal of a second frequency band higher than the first frequency band using the plurality of second patch antenna elements, a processor connected to the communication module, wherein central points of the plurality of first patch antenna elements are spaced apart from one another to have a first distance and central points of the plurality of second patch antenna elements are spaced apart from one another to have a second distance shorter than the first distance, and wherein the plurality of second patch antenna elements are arranged such that the central points of the plurality of second patch antenna elements are disposed to be closer to a central axis connecting a first central point that is a center of gravity of the first circuit hoard plane and a second central point that is a center of gravity of the second circuit hoard plane in a direction passing through the printed circuit board from a first surface to a second surface of the printed circuit board, than central points of the plurality of first patch antenna elements.

In accordance with another aspect of the disclosure, an antenna structure comprises a Printed Circuit Board (PCB), wherein the PCB includes a first circuit board plane including a plurality of first patch antenna elements formed to have a first size enabling transmission and reception of a signal of a first frequency band, a second circuit board plane including a plurality of second patch antenna elements formed to have a second size enabling transmission and reception of a signal of a second frequency band, wherein the plurality of first patch antenna elements are disposed such that central points of the plurality of first patch antenna elements are spaced apart from one another by a first distance related to a first wavelength of the first frequency band and the plurality of second patch antenna elements are disposed such that central points of the plurality of second patch antenna elements are spaced apart from one another by a second distance related to a second wavelength of the second frequency band, and wherein the plurality of second patch antenna elements are disposed above the first circuit board plane to overlap at least some of the plurality of first patch antenna elements.

In accordance with another aspect of the disclosure, an electronic device includes a Printed Circuit Board (PCB) including a first circuit board plane including a plurality of first patch antenna elements and a second circuit board plane including a plurality of second patch antenna elements, a communication module that transmits and receives a signal of a first frequency band using the plurality of first patch antenna elements, and transmits and receives a signal of a second frequency band using the plurality of second patch antenna elements, and a processor connected to the communication module. Wherein the plurality of first patch antenna elements include a first central patch disposed on a central axis of the PCB and first side patches spaced apart from each other on both sides of the first central patch, wherein the plurality of second patch antenna elements include a second central patch disposed on a central axis of the PCB and second side patches spaced apart from each other on both sides of the second central patch, and wherein the second side patches are arranged to be closer to the central axis connecting a first central point that is a center of gravity of the first circuit board plane and a second central point that is a center of gravity of the second circuit board plane in a direction passing through the printed circuit board from a first surface to a second surface of the printed circuit hoard, than central points of the first side patches, and the first central patch and the second central patch are fed using central feed terminals formed in difference directions.

Other aspects, advantages, and salient features of the disclosure will become apparent to those skilled in the art from the following detailed description, which, taken in conjunction with the annexed drawings, discloses certain embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

In the description of the drawings, the same or similar reference numerals may be used for the same or similar components.

DETAILED DESCRIPTION

Hereinafter, certain embodiments of the disclosure may be described with reference to accompanying drawings. Accordingly, those of ordinary skill in the art will recognize that modification, equivalent, and/or alternative on the certain embodiments described herein can be variously made without departing from the scope and spirit of the disclosure.

An electronic device may include patch antenna elements for each circuit board layer. The different circuit board layers may be formed with patch antenna elements of different sizes. The patch antenna element may transmit and receive an RE signal using a designated frequency band. The patch antenna element of a large size may transmit and receive signals belonging to a low frequency band, and the patch antenna element of a small size may transmit and receive signals belonging to a high frequency band. The electronic device may transmit and receive a multi-band signal using patch antenna elements having different sizes.

The central points of the small patch antenna elements may coincide with central points of the large patch antenna elements to facilitate design and manufacturing when patch antenna elements of different sizes are disposed on different circuit board layers. In this case, a spacing according to a wavelength at which the small patch antenna elements perform transmission and reception is larger than a spacing according to a wavelength at which the large patch antenna elements perform transmission and reception. Accordingly, a problem may arise in that transmission and reception characteristics related to a high frequency band in which the small patch antenna elements perform transmission and reception are changed in an undesired direction.

Certain embodiments disclosed in the disclosure may solve the problem that the spacing according to the wavelength at which the small patch antenna elements perform transmission and reception is increased when the patch antenna elements having different sizes are disposed on the same axis.

In addition, the electronic device may transmit and receive a multi-band signal using patch antenna elements having different sizes. To prevent signals of different frequency bands from being mixed, isolation characteristics may be required. However, when the center frequencies of patch antenna elements of different sizes are set to be the same, an parasitic electric field may occur. As a result, coupling may occur in feeders disposed in different directions, and cross pole isolation may occur, in which isolation characteristics are weakened between feeding ports that cross each other.

Certain embodiments disclosed herein may improve the characteristic of isolating signals of different frequency bands from each other by adjusting center frequencies of patch antenna elements having different sizes.

Figure 1:
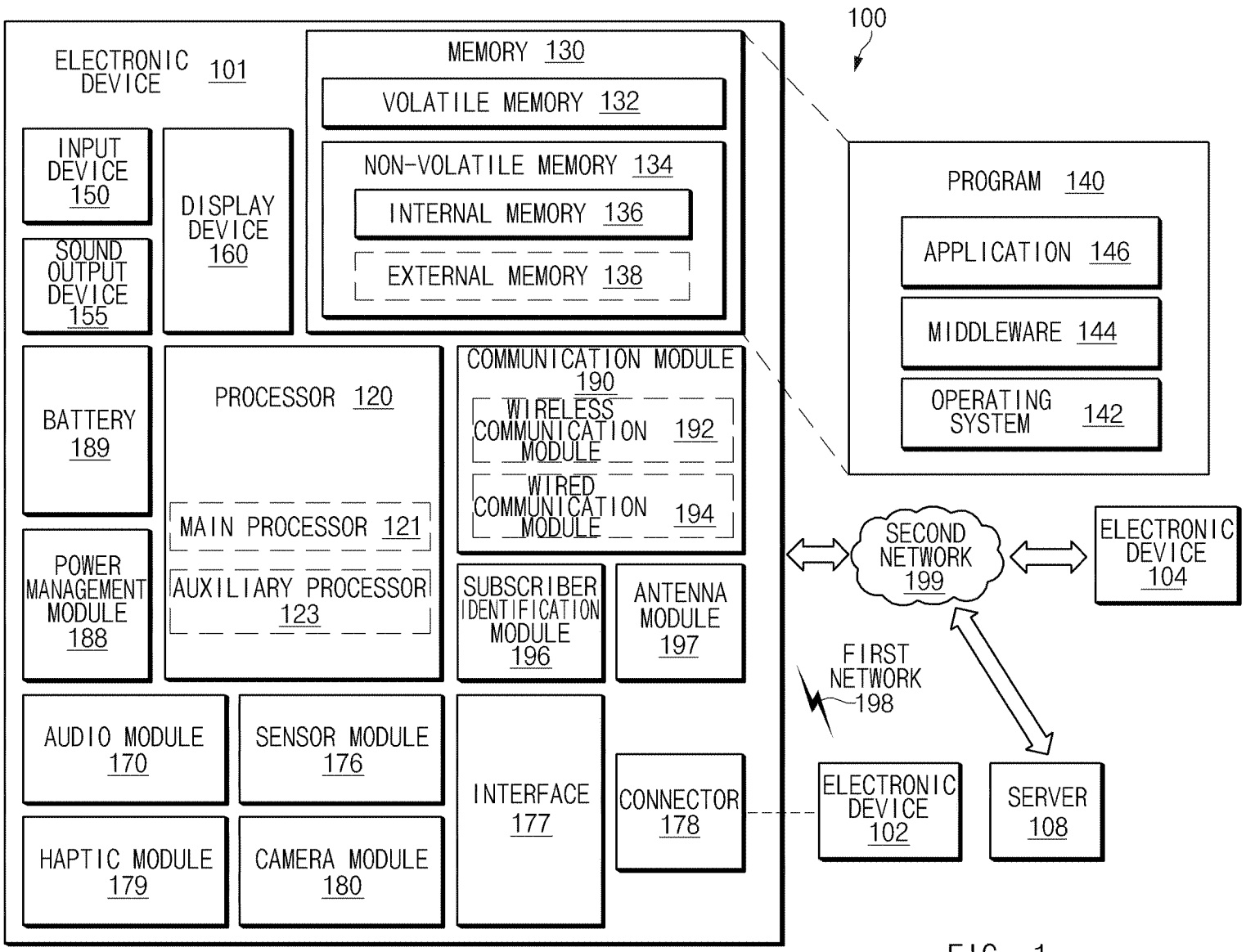
FIG. 1 is a block diagram illustrating an electronic device 101 network environment 100 according to certain embodiments.

FIG. 1 is a block diagram illustrating an electronic device 101 in a network environment 100 according to certain embodiments. Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™ wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., PCB). According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPM), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

In certain embodiments, an electronic device 101 is capable of operating on two different networks, such as a legacy network 292 (for example, 2G, 3G, 4G, LTE) and a second network 294 (for example, 5G). The first RFIC 222 converts the baseband signal from the first communication processor 212 to an RF signal for transmission, via first antenna module 242 over the first network. The second. RFIC 224 converts baseband signals from the first communication processor 212 and second communication processor 214 to an RF signal for transmission via the second antenna module 244 on a lower frequency band on the second network 294 (such as 5G Sub 6). The fourth RFIC 228 converts the baseband signal from the second communication processor to an intermediate frequency signal. The third RFIC 226 converts the intermediate frequency signal to an RF signal for transmission on the second network 294 via third antenna module 246. In certain embodiments, frequencies of the RF signal transmitted by the third antenna module 246 can be 6-60 GHz. "Equal" shall mean equal, substantially equal, or within 1% deviation. A "plane" shall mean a geometrical plane, and all points within 1% of the longest dimension to the geometrical plane.

Figure 2:
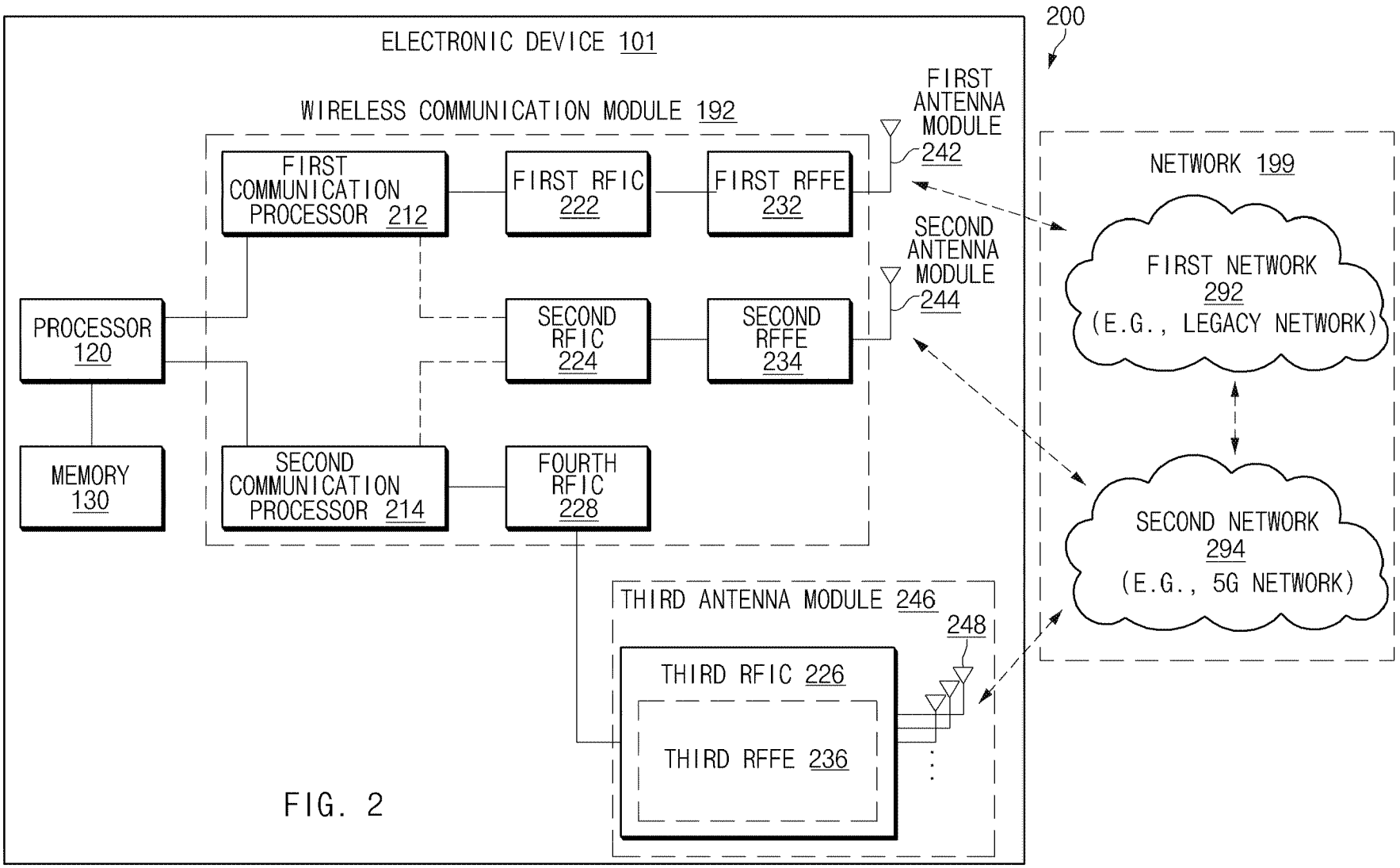
FIG. 2 is a diagram illustrating an electronic device supporting 5G communication, according to an embodiment.

FIG. 2 is a block diagram 200 of the electronic device 101 in a network environment. The network environment can include a plurality of cellular networks, according to certain embodiments. Referring to FIG. 2, the electronic device 101 may include a processor 120, memory 130, a wireless communication module 192, and a third antenna module 246. The wireless communication module 192 includes a first communication processor 212, a second communication processor 214, a first radio frequency integrated circuit (RFIC) 222, a second RFIC 224, and a third RFIC 226, a fourth RFIC 228, a first radio frequency front end (RFFE) 232, a second RFFE 234, a first antenna module 242, a second antenna module 244, and an antenna 248.

The plurality of networks 199 may include a first cellular network 292 and a second cellular network 294. According to another embodiment, the electronic device 101 may further include at least one of the components shown in FIG. 1, and the plurality of networks 199 may further include at least one another network.

According to one embodiment, the first communication processor 212, the second communication processor 214, the first RFIC 222, the second RFIC 224, the fourth RFIC 228, the first RFFE 232, and the second RFFE 234 may constitute at least a part of the wireless communication module 192. According to another embodiment, the fourth RFIC 228 may be omitted or included as a part of the third RFIC 226.

The first communication processor 212 may establish communication channel of a band to be used for wireless communication with the first cellular network 292, and support legacy network communication through the established communication channel. According to certain embodiments, the first cellular network 292 may be a legacy network including a 2G, 3G, 4G, or long term evolution (LTE) network.

The second communication processor 214 may establish a communication channel corresponding to a designated band (e.g., about 6 GHz to about 60 GHz) of bands to be used for wireless communication with the second cellular network 294, and support 5G network communication through the established communication channel. According to certain embodiments, the second cellular network 294 may be a 5G network defined in 3GPP. Additionally, according to one embodiment, the first communication processor 212 or the second communication processor 214 may establish a communication channel corresponding to another designated band (e.g., about 6 GHz or less) of bands to be used for wireless communication with the second cellular network 294 and support 5G network communication through the established communication channel.

According to one embodiment, the first communication processor 212 and the second communication processor 214 may be implemented in a single chip or a single package. According to certain embodiments, the first communication processor 212 or the second communication processor 214 may be formed in a single chip or a single package with the processor 120, the auxiliary processor 123, or the communication module 190.

The first RFIC 222 may convert a baseband signal generated by the first communication processor 212 into a radio frequency (RF) signal of about 700 MHz to about 3 GHz used in the first cellular network 292 (e.g., legacy network) in the case of transmission. In the case of reception, the RF signal may be obtained from the first cellular network 292

(e.g., legacy network) via an antenna (e.g., the first antenna module 242), and be preprocessed through an RFFE (e.g., the first RFFE 232). The first RFIC 222 may convert the preprocessed RF signal into a baseband signal so as to be processed by the first communication processor 212.

The second RFIC 224 may convert the baseband signal generated by the first communication processor 212 or the second communication processor 214 into an RF signal (hereinafter, referred to as a 5G Sub6 RF signal) of a Sub6 band (for example, about 6 GHz or less) to be used for the second cellular network 294 (e.g., 5G network) in the case of transmission. In the case of reception, the 5G Sub6 RF signal may be obtained from the second cellular network 294 (e.g., 5G network) via an antenna (e.g., the second antenna module 244), and be preprocessed through an RFFE (e.g., the second RFFE 234). The second REX 224 may convert the preprocessed 5G Sub6 RE signal into a baseband signal so as to be processed by a corresponding communication processor of the first communication processor 212 or the second communication processor 214.

The third RFIC 226 may convert the baseband signal generated by the second communication processor 214 into an RF signal (hereinafter, referred to as a 5G Above6 RE signal) of a 5G Above6 band (e.g., e about 6 GHz to about 60 GHz) to be used for the second cellular network 294 (e.g., 5G network). In the case of reception, the 5G Above6 RE signal may be obtained from the second cellular network 294 (e.g., 5G network) via an antenna (e.g., the antenna 248) and preprocessed through a third REEF 236. The third RFIC 226 may convert the preprocessed 5G Above6 RE signal into a baseband signal so as to be processed by the second communication processor 214. According to one embodiment, the third RFFE 236 may be formed as a part of the third RFIC 226.

According to one embodiment, the electronic device 101 may include the fourth RFIC 228 separately from or at least as a part of the third RFIC 226. In this case, the fourth RFIC 228 may convert the baseband signal generated by the second communication processor 214 into an RF signal (hereinafter, referred to as an IF signal) in an intermediate frequency band (e.g., about 9 GHz to about 11 GHz) and transmit the IF signal to the third RFIC 226. The third RFIC 226 may convert the IF signal into the 5G Above6 RF signal. In the case of reception, the 5G Above6 RF signal may be received from the second cellular network 294 (e.g., 5G network) via an antenna (e.g., the antenna 248) and may be converted into an IF signal by the third RFIC 226. The fourth RFIC 228 may convert the IF signal into a baseband signal so as to be processed by the second communication processor 214.

According to one embodiment, the first RFIC 222 and the second RFIC 224 may be implemented as a single chip or at least a part of a single package. According to one embodiment, the first RFFE 232 and the second RFFE 234 may be implemented as a single chip or at least a part of a single package. According to one embodiment, at least one of the first antenna module 242 or the second antenna module 244 may be omitted or combined with another antenna module to process RF signals of a corresponding plurality of bands.

According to one embodiment, the third RFIC 226 and the antenna 248 may be disposed on the same substrate to form a third antenna module 246. For example, the wireless communication module 192 or the processor 120 may be disposed on a first substrate (e.g., main PCB). In this case, the third RFIC 226 may be disposed in a partial area (e.g., bottom) of a second substrate (e.g., sub PCB), which is separate from the first substrate, and the antenna 248 may be disposed in another partial area (e.g., top), thereby forming the third antenna module 246. By placing the third RFIC 226 and the antenna 248 on the same substrate, it is possible to reduce the length of a transmission line therebetween. This may reduce the phenomenon that signals of high frequency bands (e.g., about 6 GHz to about 60 GHz) used by, for example, 5G network communications are lost (e.g., attenuated) due to transmission lines. For this reason, the electronic device 101 may improve the quality or speed of communication with the second cellular network 294 (e.g., 5G network).

According to one embodiment, the antenna 248 may be formed as an antenna array including a plurality of antenna elements that may be used for beamforming. In this case, the third RFIC 226 may include a plurality of phase shifters corresponding to the plurality of antenna elements, for example, as a part of the third RFFE 236. In transmission, each of the plurality of phase shifters may shift a phase of the 5G Above6 RF signal to be transmitted to the outside of the electronic device 101 (e.g., a base station for a 5G network) through a corresponding antenna element. In reception, each of the plurality of phase shifters may shift the phase of the 5G Above6 RF signal received from the outside through a corresponding antenna element to the same or substantially the same phase. This may enable transmission or reception through beamforming between the electronic device 101 and the outside.

The second cellular network 294 (e.g., 5G network) may be operated independently of the first cellular network 292 (e.g., legacy network) (e.g., Stand-Alone (SA)) or may be operated in conjunction with the first cellular network 292 (e.g., Non-Stand Alone (NSA)). For example, the 5G network may have only an access network (e.g., 5G radio access network (RAN) or next generation RAN (NG RAN)), but no core network (e.g., next generation core (NGC)). In this case, the electronic device 101 may access an external network (e.g., the Internet) under the control of a core network (e.g., an evolved packed core (EPC)) of the legacy network after accessing an access network of the 5G network. Protocol information (e.g., LTE protocol information) for communication with the legacy network or protocol information (e.g., New Radio (NR) protocol information) for communication with the 5G network may be stored in the memory 130 and be accessed by another component (e.g., the processor 120, the first communication processor 212, or the second communication processor 214).

Figure 3:
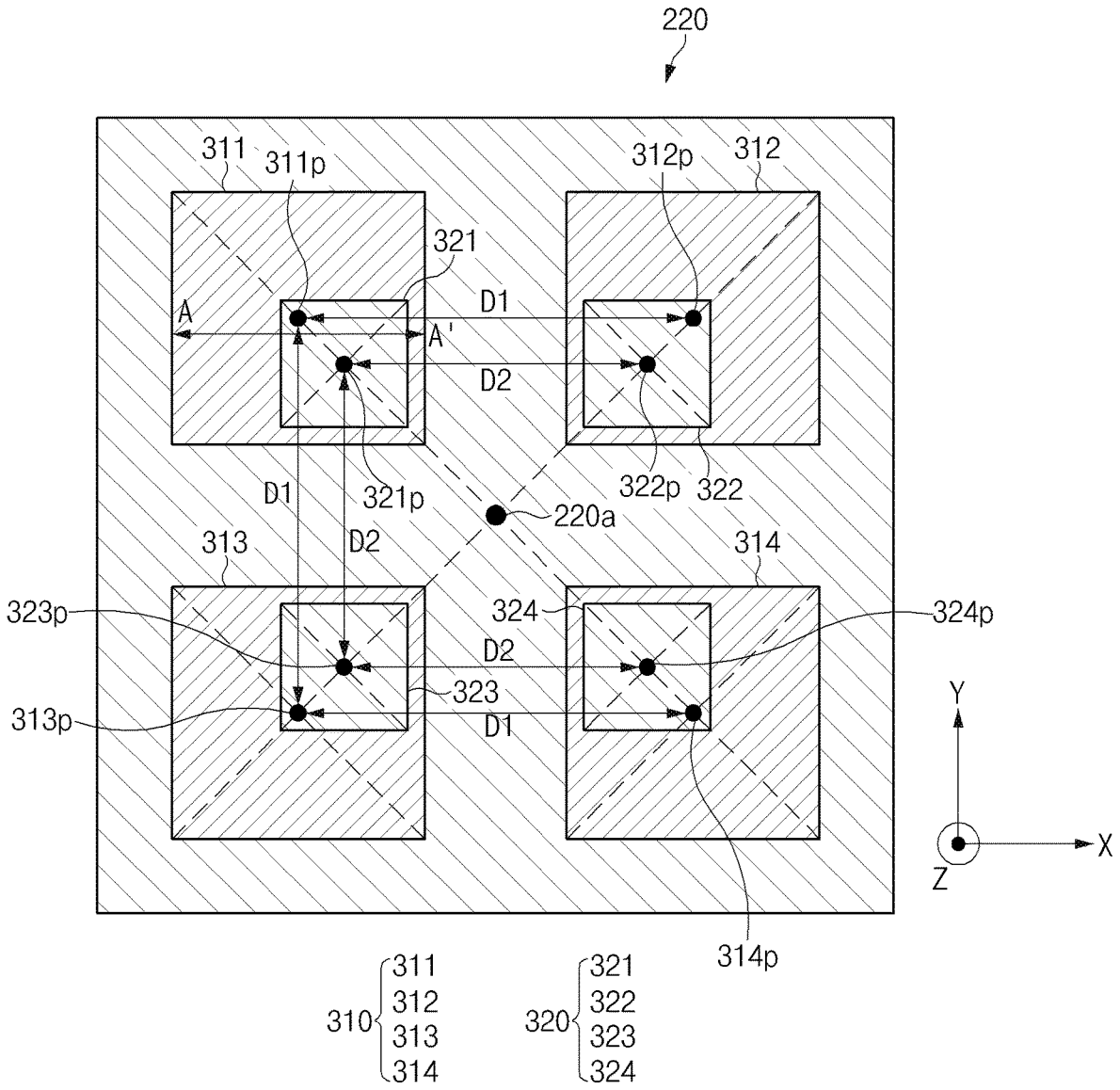
FIG. 3 is a diagram illustrating a PCB constituting an antenna structure according to an embodiment.

FIG. 3 is a diagram illustrating a printed circuit board 220 (hereinafter, referred to as a "PCB") constituting an antenna structure according to an embodiment. The PCB 220 connected to the communication module 190 may configure an antenna structure. The PCB 220 configuring the antenna structure may transmit and receive an RF signal of a designated frequency band so as for the communication module 190 to transmit or receive a signal using a plurality of patch antenna elements. The PCB 220 may include a first circuit board layer 310 and a second circuit board layer 320.

In one embodiment, the first circuit board layer 310 may include a plurality of first patch antenna elements 311 to 314. The plurality of first patch antenna elements 311 to 314 may be included in a first antenna array. FIG. 3 illustrates a case in which the number of the plurality of first patch antenna elements 311 to 314 is four. The four first patch antenna elements 311 to 314 may be arranged in two columns in the X-axis direction and two rows in the Y-axis direction. However, the disclosure is not limited thereto, and the four first patch antenna elements 311 to 314 may be arranged in line in the X-axis direction (one row) or the Y-axis direction (one column). In addition, the number of the plurality of first patch antenna elements 311 to 314 may be four or more or less than four. For example, in one embodiments, there may be six patch antenna elements arranged in either two rows having three columns, or three rows having two columns.

In one embodiment, the plurality of first patch antenna elements 311 to 314 may transmit or receive a signal of a first frequency band. For example, the first frequency band may be a frequency band which has a center frequency of about 28 GHz, and is in a range of about 27 GHz to about 29 GHz. Each of the plurality of first patch antenna elements 311 to 314 may be formed to have a first size capable of transmitting or receiving a signal of the first frequency band. The first size may be a size related to a first wavelength that is a wavelength of the first frequency band. According to certain embodiments, the plurality of first patch antenna elements 311 to 314 may be formed in various shapes. For example, the plurality of first patch antenna elements 311 to 314 may have a triangular, circular, or rhombic shape.

In one embodiment, the plurality of first patch antenna elements 311 to 314 may have central points 311*p* to 314*p*, respectively. Each of the central points 311*p* to 314*p* of the plurality of first patch antenna elements 311 to 314 may be defined as a center of gravity of each of the plurality of first patch antenna elements 311 to 314. For example, when each of the plurality of first patch antenna elements 311 to 314 has a quadrangular shape, a central point of each of the plurality of first patch antenna elements 311 to 314 may be defined as an intersection point of two diagonal lines of each of the plurality of first patch antenna elements 311 to 314. From hereinafter, "center" shall be understood to mean "substantially the center" or "at least within 1% deviation of the length along any corresponding dimension." Distances shall be understood to mean substantially said distance and including at least within 1% of said distance. A "line" shall be understood to mean "substantially a line" and shall a line through the endpoints of the line and all points that are within 1% of the length from the line through the endpoints. Parallel shall mean parallel, substantially parallel or within 3 degrees. Orthogonal shall mean orthogonal, substantially orthogonal, or within 3 degrees of orthogonal.

In one embodiment, the plurality of first patch antenna elements 311 to 314 may be disposed such that the central points 311*p* to 314*p* are spaced apart from one another by a first distance D1 related to a first wavelength of the first frequency band. For example, a distance between the central point 311*p* of the first patch antenna element 311 disposed at the upper left portion and the central point 312*p* of the first patch antenna element 312 disposed at the upper right portion may be the first distance D1. As another example, the distance between the central point 311*p* of the first patch antenna element 311 disposed at the upper left portion and the central point 313*p* of the first patch antenna element 313 disposed at the lower left portion may be the first distance D1.

In one embodiment, the second circuit board layer 320 may include a plurality of second patch antenna elements 321 to 324. The plurality of second patch antenna elements 321 to 324 may be included in a second antenna array.

In one embodiment, the plurality of second patch antenna elements 321 to 324 may overlap at least some of the plurality of first patch antenna elements 311 to 314. For example, as illustrated in FIG. 3, the plurality of second patch antenna elements 321 to 324 may be respectively disposed to completely overlap the plurality of first patch antenna elements 311 to 314. As another example, the plurality of second patch antenna elements 321 to 324 may be arranged to overlap the plurality of first patch antenna elements 311 to 314 in at least a partial area.

In one embodiment, the plurality of second patch antenna elements 321 to 324 may be disposed above the first circuit board layer 310. The plurality of second patch antenna elements 321 to 324 may be disposed on the first circuit board layer 310 in the Z-axis direction, thereby forming a plane parallel to the first circuit board layer or a second circuit board layer 320.

In one embodiment, the plurality of second patch antenna elements 321 to 324 may transmit or receive a signal of a second frequency band. For example, the second frequency band may be a frequency band having a center frequency of about 39 GHz, and having a range of about 38 GHz to about 40 GHz. Each of the plurality of second patch antenna elements 321 to 324 may be formed to have a second size capable of transmitting or receiving a signal of the second frequency band. The second size may be a size related to a second wavelength that is a wavelength of a signal belonging to the second frequency band.

In one embodiment, the plurality of second patch antenna elements 321 to 324 may have central points 321*p* to 324*p*, respectively. Each of the central points 321*p* to 324*p* of the plurality of second patch antenna elements 321 to 324*p* may be defined as a center of gravity of each of the plurality of second patch antenna elements 321 to 324. For example, when each of the plurality of second patch antenna elements 321 to 324 has a quadrangular shape, a central point of each of the plurality of second patch antenna elements 321 to 324 may be defined as an intersection point of two diagonal lines of each of the plurality of second patch antenna elements 321 to 324. According to certain embodiments, the plurality of second patch antenna elements 321 to 324 may be formed in various shapes. For example, the plurality of second patch antenna elements 321 to 324 may have a triangular, circular, or rhombic shape.

In one embodiment, the plurality of second patch antenna elements 321 to 324 may be disposed such that the central points 321*p* to 324*p* are spaced apart from one another by a second distance D2 related to a second wavelength of the second frequency band. For example, a distance between the central point 321*p* of the second patch antenna element 321 disposed at the upper left portion and the central point 322*p* of the second patch antenna element 322 disposed at the upper right portion may be the second distance D2. As another example, a distance between the central point 321*p* of the second patch antenna element 321 disposed at the upper left portion and the central point 323*p* of the second patch antenna element 323 disposed at the lower left portion may be the second distance D2.

In one embodiment, the PCB 220 may have a central axis 220*a*—a line orthogonal to the PCB and proceeding through a center of gravity of the PCB. For example, the central axis 220*a* may be an axis passing through the central point of the PCB 220 in the Z-axis direction. When the first circuit board layer 310 and the plane or second circuit board layer 320 (second circuit board layer shall now also refer to the plane) constituting the PCB 220 has a rectangular shape, the central axis 220*a* may be an axis connecting a first central point that is a center of gravity of the first circuit board layer 310 and a second central point that is a center of gravity of the second circuit board layer 320 in the Z-axis direction which is a direction passing through the PCB 220 from a first surface to a second surface.

In one embodiment, the central points 321*p* to 324*p* of the plurality of second patch antenna elements 321 to 324 may be disposed closer to the central axis 220*a* or center of gravity of the PCB 220 than the central points 311*p* to 314*p* of the plurality of first patch antenna elements 311 to 314. The plurality of first patch antenna elements 311 to 314 may be disposed to be spaced apart from the central axis 220*a* of the PCB 220. The central points 321*p* to 324*p* of the plurality of second patch antenna elements 321 to 324 may be disposed closer to the central axis 220*a* of the PCB 220 than the central points 311*p* to 314*p* of the plurality of first patch antenna elements 311 to 314.

In one embodiment, the first distance D1 may be longer than the second distance D2. Each of the central points 311*p* to 314*p* of the plurality of first patch antenna elements 311 to 314 may be spaced apart from the central axis 220*a* of the PCB 220. Each of the central points 321*p* to 324*p* of the plurality of second patch antenna elements 321 to 324 may be disposed closer to the central axis 220*a* or center or gravity (now collectively referred to as central axis) of the PCB 220. A distance from the central axis 220*a* of the PCB 220 to the central points 311*p* to 314*p* of the plurality of first patch antenna elements 311 to 314 may be longer than a distance from the central axis 220*a* of the PCB 220 to the central points 321*p* to 324*p* of the plurality of second patch antenna elements 321 to 324. A distance between the central points 311*p* to 314*p* of the plurality of first patch antenna elements 311 to 314 may be longer than a distance between the central points 321*p* to 324*p* of the plurality of second patch antenna elements 321 to 324.

Figure 4:
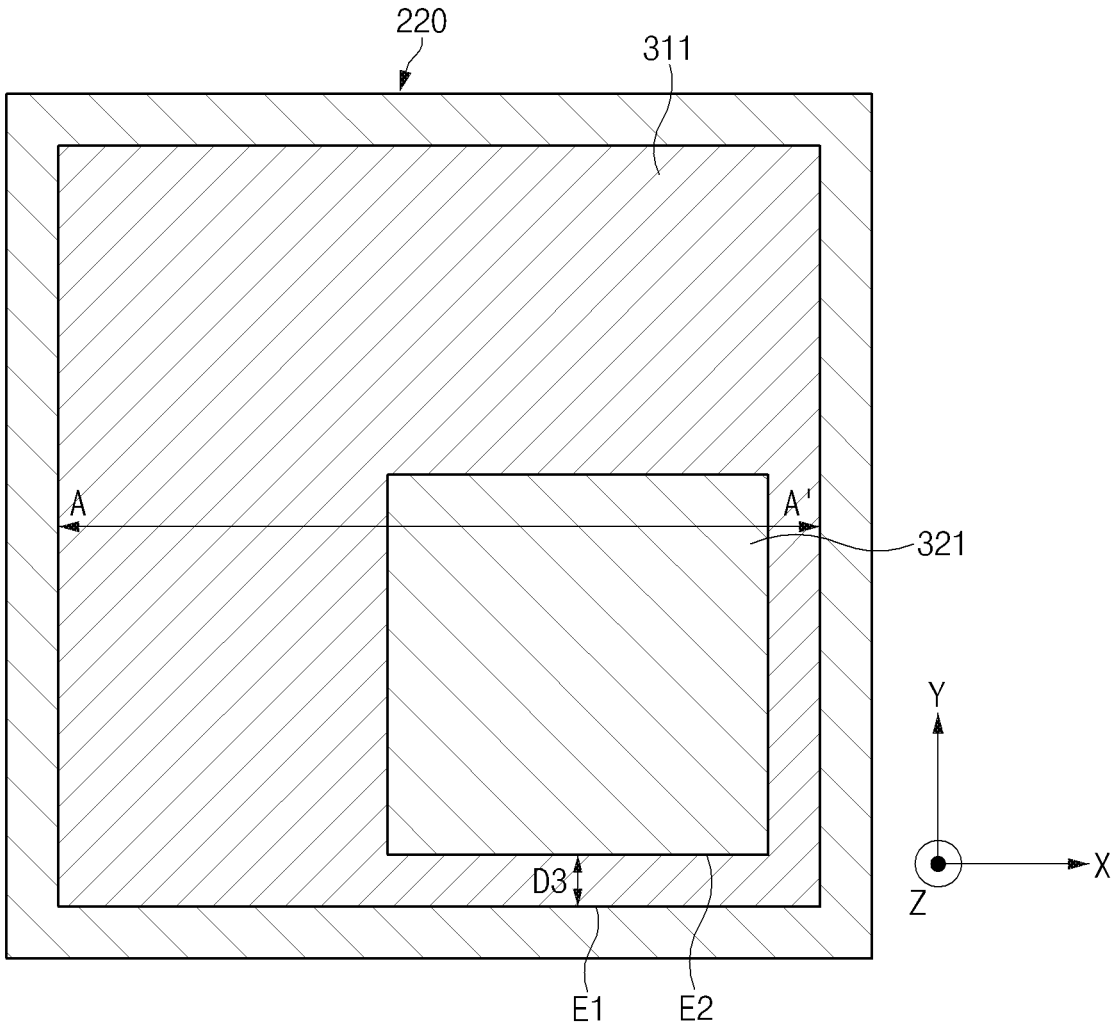
FIG. 4 is a view illustrating in detail a part of a PCB according to an embodiment.

FIG. 4 is a view illustrating a part of the PCB 220 according to an embodiment in detail. Any one first patch antenna element 311 of the plurality of first patch antenna elements 311 to 314 and a corresponding second patch antenna element 321 disposed on the one first patch element are illustrated in FIG. 4.

In one embodiment, the any one first patch antenna element 311 of the plurality of first patch antenna elements 311 to 314 may have a first edge E1 proximate to the central axis 220*a*. For example, the first edge E1 of the first patch antenna element 311 disposed on the upper left portion among the plurality of first patch antenna elements 311 to 314 may be defined as a lower edge and a right edge.

In one embodiment, the any one second patch antenna element 321 of the plurality of second patch antenna elements 321 to 324 may have a second edge E2 proximate to the central axis 220*a*. For example, the second edge E2 of the second patch antenna element 321 may be defined as a lower edge and a right edge.

In one embodiment, the second edge E2 may be closer to the central point 311*p* of the any one first antenna element 311 than the first edge E1. In another embodiment, any edge of the second antenna element 321 may be closer than any edge of the first antenna element 311 to the central point 311*p*. The second edge E2 may be disposed inside the first edge E1 based on the central point 311*p* of the first antenna element 311.

According to one embodiment, when the second patch antenna element 321 has an edge disposed further inward than the first patch antenna element 311 based on the central point 311*p* of the first antenna element 311, an area between the first edge E1 and the second edge E2 may be defined as a fringing field space.

In one embodiment, when there is no fringing field space in a case where the second antenna element 321 is vertically or horizontally fed, for example, the first edge E1 and the second edge E2 overlap each other or a part of the second antenna element 321 is disposed not to overlap the first antenna element 311, one side (upper end or left side) of the second antenna element 321 may form a fringing field with the first antenna element 311, and the other side (lower end or right side) may form a fringing field with ground of the PCB 220. In this case, the shape of the fringing field formed on the top/bottom or the left/right may be asymmetrical so that a radial direction of the second antenna element 321 may be inclined in a specific direction and normal beamforming may not be possible.

In one embodiment, the second edge E2 of the second antenna element 321 may be disposed further inward than the first edge E1 of the first antenna element 311 of the PCB 220, thereby securing a fringing field space. Accordingly, the other side (lower end or right side) of the second antenna element 321 may form a fringing field with the first antenna element 311 such that the fringing field is symmetrical, thereby allowing the electronic device 101 to normally perform radiation and beamforming of the signal.

In one embodiment, the distance between the first edge E1 and the second edge E2 may be a third distance D3. The third distance D3 may be a width of a narrow area among areas where the first antenna element 311 does not overlap with the second antenna element 321.

Figure 5A:
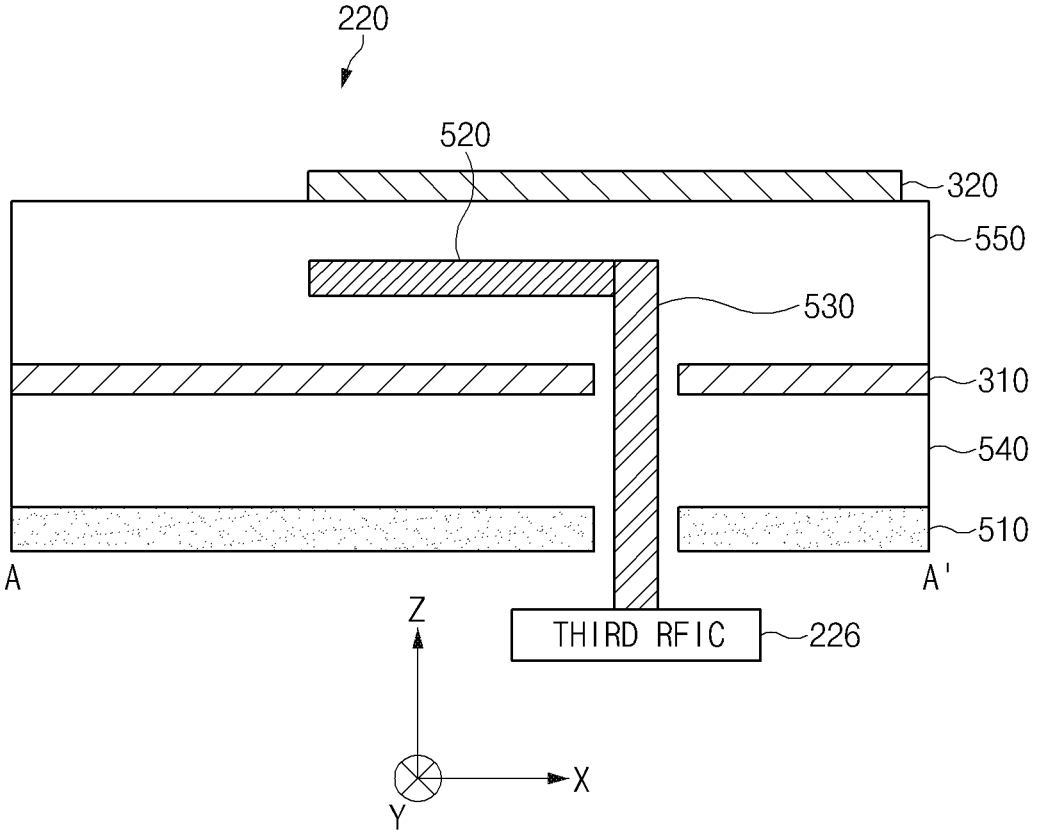
FIGS. 5A, 5B and 5C are cross-sectional views of the PCB of the FIGS. 3 and 4, taken along the direction A-A'.
Figure 5B:
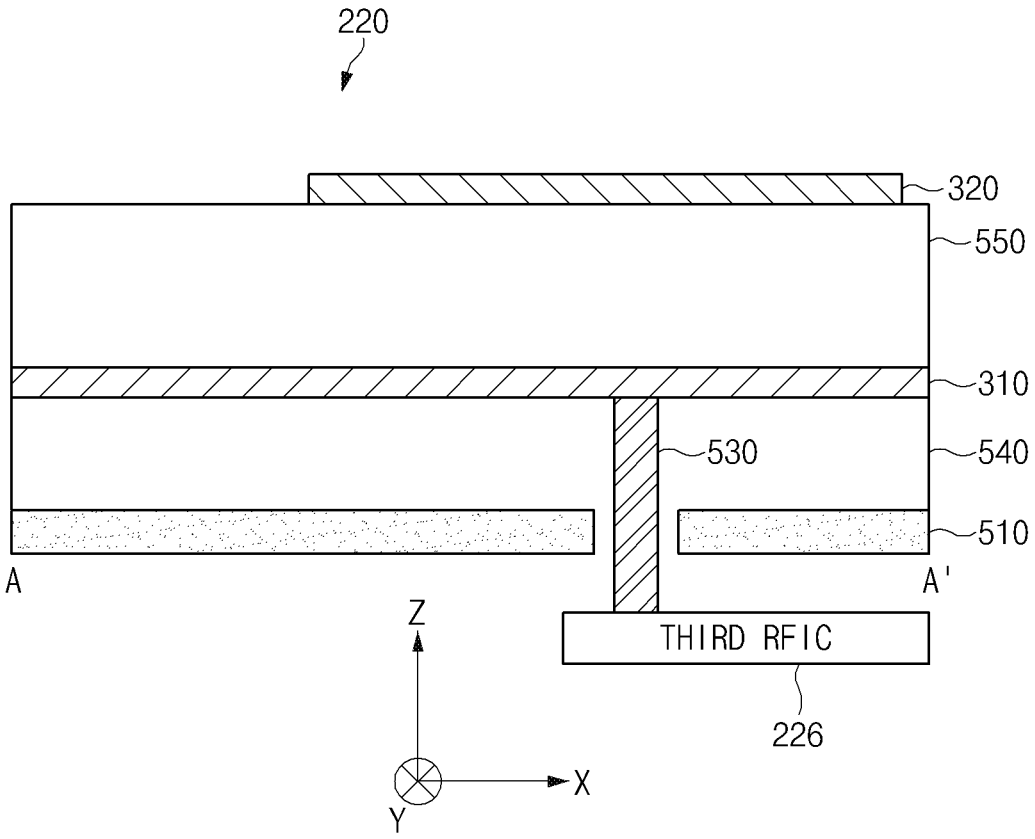
Figure 5C:
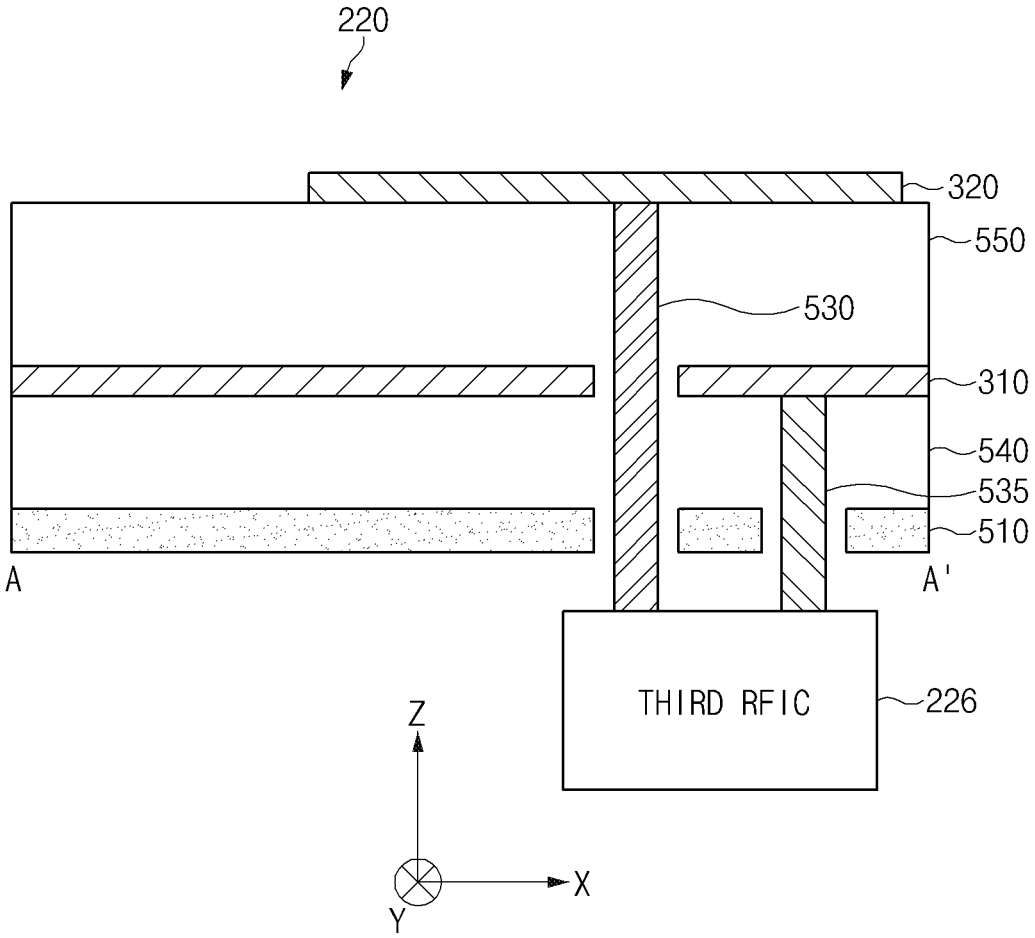

FIGS. 5A, 5B and 5C are cross-sectional views of the PCB 220 of the FIGS. 3 and 4, taken along the direction A-A'. The PCB 220 according to an embodiment may include the third RFIC 226, the first circuit board layer 310, the second circuit board layer 320, a ground layer 510, a first insulating layer 540, and a second insulating layer 550.

In one embodiment, the first antenna patch elements/first circuit board layer 310 and the second antenna patch elements/second circuit board layer 320 may be disposed on different layers (e.g., upper surface of first insulating layer 540 and upper surface of second insulating layer 550) of the PCB 220. For example, the first circuit board layer 310 may be disposed parallel to the XY plane, and the second circuit board layer 320 may be disposed above the first circuit board layer 310 based on the Z axis. The second circuit board layer 320 may be disposed to be biased toward one side on the top of the first circuit board layer 310. The first circuit board layer 310 may include the first antenna element 311. The second circuit board layer 320 may include the second antenna element 321.

In one embodiment, the third RFIC 226 may transfer a signal by feeding the first circuit board layer 310 and the second circuit board layer 320. The third RFIC 226 may feed the plurality of first patch antenna elements 311 to 314 and the plurality of second patch antenna elements 321 to 324.

In one embodiment, the ground layer 510 may further include a plurality of layers on a rear surface thereof. For example, the lowermost layer among the plurality of layers included in the PCB 220 may be a layer for feeding the antenna. An RFIC (e.g., the third RFIC 226) and a circuit may be mounted on the lowermost layer of the PCB 220. The layers between the lowermost layer and the ground layer 510 may further include a line interconnecting the RFIC and the circuit and via holes connecting the layers. The RFIC and the circuit may transmit and receive a signal of a first frequency domain and a signal of a second frequency domain via a first antenna array including the first antenna elements 311 to 314 and a second antenna array including the second antenna elements 321 to 324.

In one embodiment, as shown in FIG. 5A, the third RFIC 226 may feed the first circuit board layer 310 and the second circuit board layer 320 using a feeding coupler 520. The third RFIC 226 may be connected to the feeding coupler 520 using a connector 530.

In one embodiment, the feeding coupler 520 may feed the first antenna array including the first antenna elements 311 to 314 and the second antenna array including the second antenna elements 321 to 324. For example, the feeding coupler 520 may be supplied with a signal of a first frequency band for feeding the first antenna array including the first antenna elements 311 to 314 from the third RFIC 226 disposed on the lowermost layer of the PCB 220. As another example, the feeding coupler 520 may be supplied with a signal of a second frequency band for feeding the second antenna array including the second antenna elements 321 to 324 from the third RFIC 226. As still another example, the feeding coupler 520 may transmit and receive signals to and from the third. RFIC 226 disposed on the lowermost layer of the PCB 220.

In one embodiment, one side of the connector 530 may extend from the third RFIC 226 provided on the lowermost layer of the PCB 220, and the other side thereof may be connected to one side of the feeding coupler 520. The connector 530 may pass through at least a part of the first circuit board layer 310 and the ground layer 510. For example, a via hole is formed in the at least a part of the first circuit board layer 310 and the ground layer 510 and therefore, the connector 530 may pass through the at least a part of the first circuit board layer 310 and the ground layer 510.

In one embodiment, the connector 530 may pass through the first circuit board layer 310. The connector 530 may extend in the Z-axis direction, which is the height direction of the first circuit board layer 310 and pass through the first circuit board layer 310 in the Z-axis direction. To prevent the connector 530 and the first circuit board layer 310 from being short-circuited, a separate insulating layer may be formed or an insulating material is provided on a surface of the connector 530 or a pass-through portion of the first circuit board layer 310.

In one embodiment, the first insulating layer 540 may be disposed between the first circuit board layer 310 and the ground layer 510. The first insulating layer 540 may support the plurality of first patch antenna elements 311 to 314 included in the first circuit board layer 310. The first insulating layer 540 may electrically insulate the first circuit board layer 310 and the ground layer 510 from each other.

In one embodiment, the second insulating layer 550 may be disposed between the first circuit board layer 310 and the second circuit board layer 320. The second insulating layer 550 may support the plurality of second patch antenna elements 321 to 324 included in the second circuit board layer 320. The second insulating layer 550 may electrically insulate the first circuit board layer 310 and the second circuit board layer 320 from each other.

In one embodiment, the connector 530 may pass through at least a part of the first insulating layer 540 and the second insulating layer 550. The connector 530 may pass through the first insulating layer 540 in the Z-axis direction. The connector 530 may pass through at least a part of the second insulating layer 550 in the Z-axis direction after passing through the first circuit board layer 310.

In one embodiment, the feeding coupler 520 may penetrate at least a part of the second insulating layer 550. The feeding coupler 520 may be disposed inside the second insulating layer 550 to be spaced apart from the first circuit board layer 310 and the second circuit board layer 320. For example, the feeding coupler 520 may be disposed to pass through at least a part of the second insulating layer 550 in the X-axis direction. For another example, the feeding coupler 520 may be disposed to pass through at least a part of the second insulating layer 550 in the Y-axis direction.

In one embodiment, the third RFIC 226 may be connected to a feeder. The feeder may be a direct feeder that generates a signal to be fed and receives a signal from the first circuit board layer 310 and the second circuit board layer 320. The feeder may be provided separately from the third RFIC 226 or may be included in the third RFIC 226.

In one embodiment, the feeder may be connected to the first circuit board layer 310 using the connector 530. The plurality of first patch antenna elements 311 to 314 included in the first circuit board layer 310 may be connected to the third RFIC 226 to be fed from the third RFIC 226. The plurality of first patch antenna elements 311 to 314 may be connected to the third RFIC 226 by using the connector 530 and the feeder to transmit and receive signals of the first frequency band to and from the third RFIC 226.

In one embodiment, the plurality of second patch antenna elements 321 to 324 included in the second circuit board layer 320 may be coupled with the plurality of first patch antenna elements 311 to 314. The plurality of second patch antenna elements 321 to 324 may transmit and receive signals in the second frequency band to and from the plurality of first patch antenna elements 311 to 314. The plurality of first patch antenna elements 311 to 314 may transmit and receive signals of the second frequency band to and from the third RFIC 226 through the feeder.

In one embodiment, the third RFIC 226 may be connected to first and second feeders. The first feeder may be a direct feeder that generates a signal of the second frequency band and receives a signal of the second frequency band from the second circuit board layer 320. The second feeder may be a direct feeder that generates a signal of the first frequency band and receives a signal of the first frequency band from the first circuit board layer 310. The first and second feeders may be provided separately from the third RFIC 226 or may be included in the third RFIC 226.

In one embodiment, the first feeder may be connected to the second circuit board layer 320 using the connector 530. The second feeder may be connected to the first circuit board layer 310 using an auxiliary connector 535. The plurality of first patch antenna elements 311 to 314 included in the first circuit board layer 310 may be connected to the third RFIC 226 to be fed from the third RFIC 226. The plurality of first patch antenna elements 311 to 314 may be connected to the third RFIC 226 by using the auxiliary connector 535 and the second feeder to transmit and receive a signal of the first frequency band to and from the third RFIC 226.

In one embodiment, the connector 530 may be connected to the second circuit board layer 320 by passing through the first circuit board layer 310. The plurality of second patch antenna elements 321 to 324 included in the second circuit board layer 320 may be connected to the third RFIC 226 to be fed from the third RFIC 226. The plurality of second patch antenna elements 321 to 324 may be connected to the third RFIC 226 using the connector 530 and the first feeder to transmit and receive a signal of the second frequency band to and from the third RFIC 226.

Figure 6:
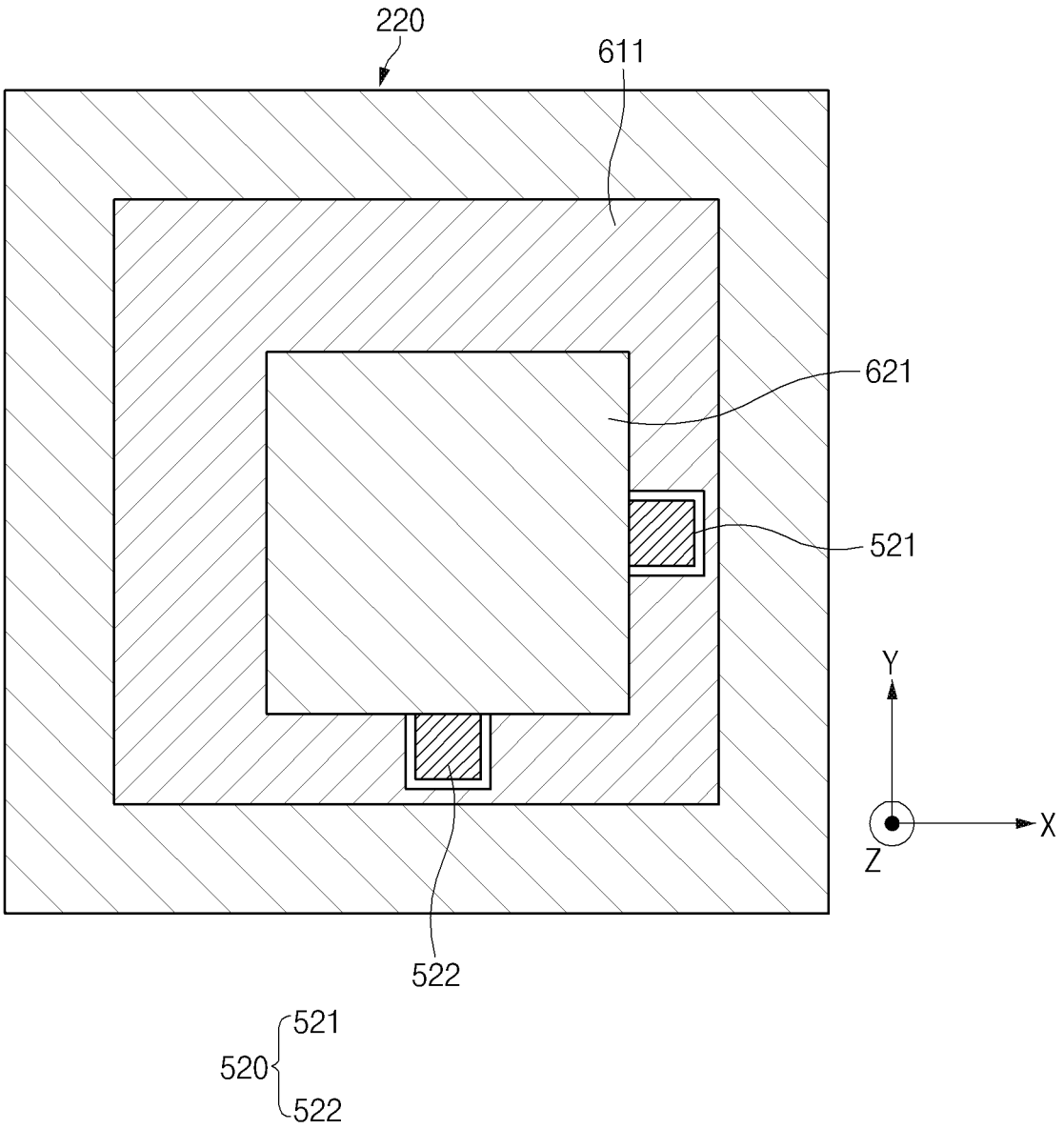
FIG. 6 is a view showing a PCB according to another embodiment.

FIG. 6 is a view showing the PCB 220 according to another embodiment. The PCB 220 according to another embodiment may include a first detune patch 611, a second detune patch 621, and a feed terminal 520. The feed terminal 520 may include a first feed terminal 521 and a second feed terminal 522.

In one embodiment, the first detune (or de-tune) patch 611 may be a patch in which sizes of at least some of the plurality of first patch antenna elements 311 to 314 are adjusted. FIG. 6 illustrates a case in which the first detune patch 611 is a patch in which the sizes of the first patch antenna element 311 disposed in the upper left portion of FIG. 3 are adjusted. The first detune patch 611 may be provided on the first circuit board layer 310 of the PCB 220. The first detune patch 611 may replace the plurality of first patch antenna elements 311 to 314 by performing the same function as the plurality of first patch antenna elements 311 to 314.

In one embodiment, the second detune patch 621 may be a patch in which sizes of at least some of the plurality of second patch antenna elements 321 to 324 are adjusted. FIG. 6 illustrates a case in which the second detune patch 621 is a patch in which a size of the second patch antenna element 321 disposed in the upper left portion of FIG. 3 is adjusted. The second detune patch 621 may be provided on the second circuit board layer 320 of the PCB 220. The second detune patch 621 may replace the plurality of second patch antenna elements 321 to 324 by performing the same function as the plurality of second patch antenna elements 321 to 324.

In one embodiment, the first detune patch 611 may have a size 6% to about 10% smaller than a size of first patch antenna elements 311 to 314. The first detune patch 611 may tune a center frequency to optimally transmit or receive a signal having a frequency of 1.06f-1.10f, where f is the resonant frequency of the plurality of first patch antenna elements 311 to 314. For example, a resonant frequency of the first detune patch 611 may be about 29 GHz tuned to be higher than the center frequency of the first frequency band.

In one embodiment, the second detune patch 621 may have a size 4% to about 8% larger than a size of the plurality of second patch antenna elements 321 to 324. The second detune patch 621 may tune a center frequency to optimally transmit or receive a signal having a frequency of 0.92f-0.96f, where f is the resonant frequency of the plurality of second patch antenna elements 321 to 324. For example, the resonant frequency of the second detune patch 621 may be about 37 GHz tuned to be lower than the center frequency of the second frequency band.

In one embodiment, the first feed terminal 521 may transmit and receive a signal polarized in the first direction. The first feed terminal 521 may be formed to pass through the first detune patch 611 disposed on the first circuit board layer 310. The first feed terminal 521 may extend toward an edge of the second detune patch 621 and be disposed between the first detune patch 611 and the second detune patch 621 based on the Z axis.

In one embodiment, the second feed terminal 522 may transmit and receive a signal polarized in a second direction. The second direction may be perpendicular to the first direction. The second feed terminal 522 may be formed to pass through the first detune patch 611 disposed on the first circuit board layer 310. The second feed terminal 522 may extend toward an edge of the second detune patch 621 and be disposed between the first detune patch 611 and the second detune patch 621 based on the Z axis.

In one embodiment, the first feed terminal 521 and the second feed terminal 522 may be perpendicular to each other. For example, the first feed terminal 521 may extend toward a one side of the second detune patch 621 in the X-axis direction, and the second feed terminal 522 may extend toward another side of the second detune patch 621 in the Y-axis direction. It is possible to transmit and receive both signals polarized in different directions using the first feed terminal 521 and the second feed terminal 522. An isolating characteristic may be required to separate a signal transmitted or received at the first feed terminal 521 and a signal transmitted or received at the second feed terminal 522 from each other.

In one embodiment, in the case of applying structures of the first feed terminal 521 and the second feed terminal 522 to the plurality of first patch antenna elements 311 to 314 having a first size and the plurality of second patch antenna elements 321 to 324 having a second size, an unnecessary electric field may occur. When an unnecessary electric field occurs in the first detune patch 611 and the second detune patch 621, a coupling by the electric field may occur between the first feed terminal 521 and the second feed terminal 522. When the coupling occurs between the first feed terminal 521 and the second feed terminal 522, a cross pole isolation in which signals polarized in different directions are mixed may occur.

In one embodiment, the center frequency of the first detune patch 611 and the center frequency of the second detune patch 621 may be set by setting the sizes of the first detune patch 611 and the second detune patch 621 to a size different from the first size and the second size. When the center frequency of the first detune patch 611 and the center frequency of the second detune patch 621 are changed, an unnecessary electric field may be removed. Accordingly, when structures of the first feed terminal 521 and the second feed terminal 522 are applied to the first detune patch 611 and the second detune patch 621, coupling by the electric field may not occur, thereby preventing the cross pole isolation.

Figure 7:
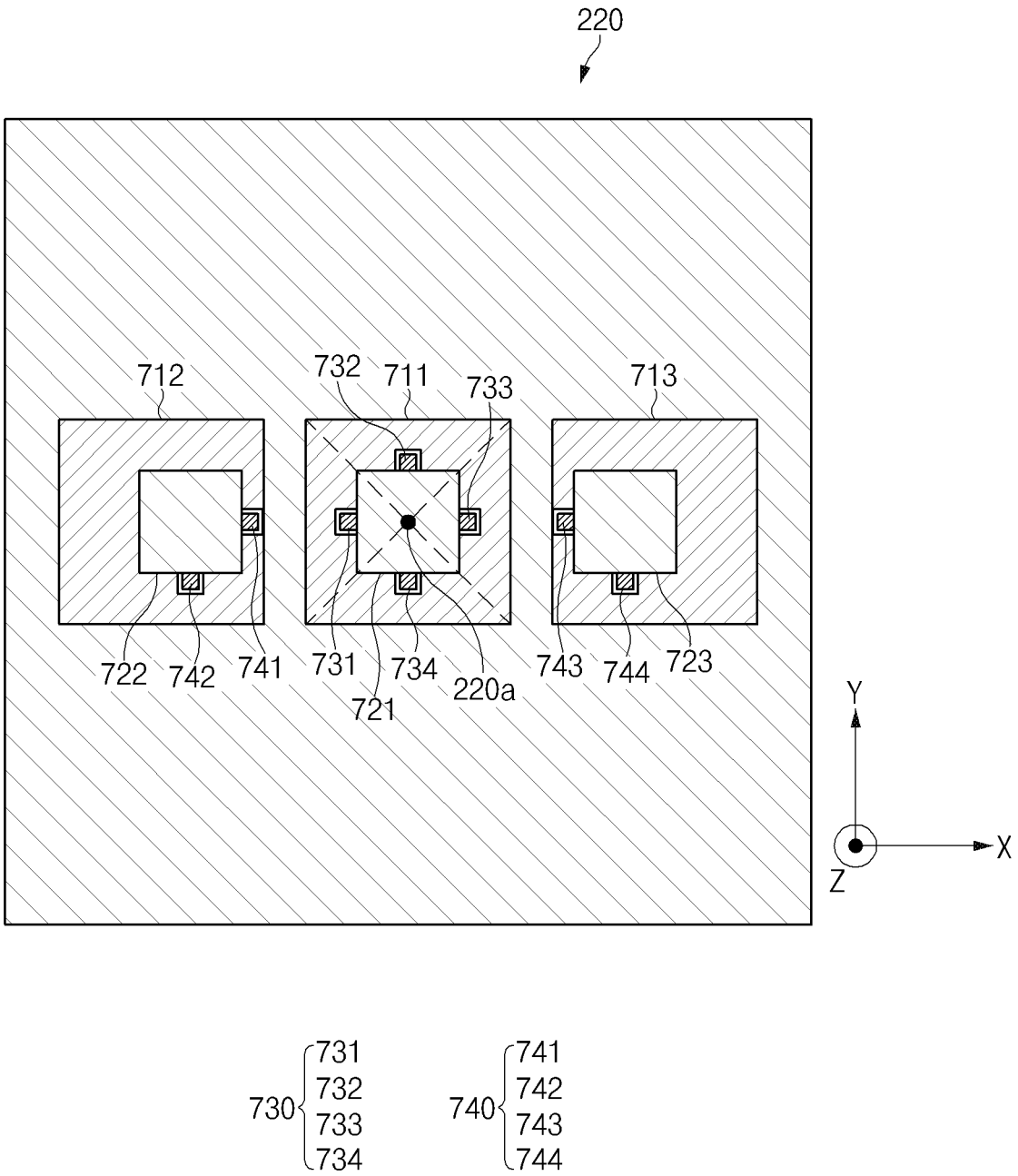
FIG. 7 is a view showing a PCB according to still another embodiment.

FIG. 7 is a diagram illustrating the PCB 220 according to still another embodiment. The PCB 220 according to still another embodiment may include a plurality of first patch antenna elements 711 to 713, a plurality of second patch antenna elements 721 to 723, central feed terminals 730, and edge feed terminals 740.

In one embodiment, the plurality of first patch antenna elements 711 to 713 may include the first central patch 711 and the first side patches 712 and 713. The first central patch 711 may be disposed on a central axis 200*a* of the PCB 220. The first side patches 712 and 713 may be spaced apart from both sides of the first central patch 711. For example, the first side patches 712 and 713 may be spaced apart from the first central patch 711 in the X-axis direction.

In one embodiment, the plurality of second patch antenna elements 721 to 723 may include the second central patch 721 and the second side patches 722 and 723. The second central patch 721 may be disposed on the central axis 200*a*/center point (0.495x-0.505x, 0.495y-0.505y) or center of gravity of the PCB 220. The second central patch 721 may be disposed to overlap the first central patch 711. The second side patches 722 and 723 may be spaced apart from both sides of the second central patch 721. For example, the second side patches 722 and 723 may be spaced apart from the second central patch 721 in the X-axis direction. The second side patches 722 and 723 may be disposed to at least partially overlap the first side patches 712 and 713.

In one embodiment, the central points of the second side patches 722 and 723 may be disposed closer to the central axis 220*a* than the central points of the first side patches 712 and 713. The first side patches 712 and 713 may transmit or receive a signal of a first frequency band. The second side patches 722 and 723 may transmit or receive a signal of a second frequency band. A signal belonging to the second frequency band may have a higher frequency than a signal belonging to the first frequency band.

In one embodiment, the signal belonging to the second frequency band may have a shorter wavelength than the signal belonging to the first frequency band. When the second side patches 722 and 723 are disposed at the same interval as the first side patches 712 and 713, a problem may occur in that the wavelength versus spacing of the second central patch 721 and the second side patches 722 and 723 is greater than the wavelength versus spacing of the first central patch 711 and the first side patches 712 and 713.

In one embodiment, when the central points of the second side patches 722 and 723 are disposed closer to the central axis 220*a* than the central points of the first side patches 712 and 713, the wavelength versus spacing of the first central patch 711 and the first side patches 712 and 713 may be maintained to be equal to the wavelength versus spacing of the second central patch 721 and the second side patches 722 and 723. Accordingly, both the signal in the first frequency band and the signal in the second frequency band may be transmitted or received under optimum conditions.

In one embodiment, the first central patch 711 and the second central patch 721 may be fed using the central feed terminals 730 formed in different directions. For example, the central feed terminals 730 may include first to fourth central feed terminals 731 to 734.

In one embodiment, the first central feed terminal 731 may be formed in a first direction of the second central patch 721. For example, the first central feed terminal 731 may protrude in the X-axis direction from a corner on one side of the second central patch 721.

In one embodiment, the second central feed terminal 732 may be formed in a second direction of the second central patch 721. The second direction may be a direction perpendicular to the first direction. For example, the second central feed terminal 732 may protrude in the Y-axis direction from a corner adjacent to a corner at which the first central feed terminal 731 is disposed, among the corners of the second central patch 721.

In one embodiment, the third central feed terminal 733 may be formed in the first direction of the second central patch 721. The third central feed terminal 733 may be disposed on the opposite side to the first central feed terminal 731 based on the second central patch 721. For example, the third central feed terminal 733 may protrude in the X-axis direction from a corner parallel to a corner at which the first central feed terminal 731 is disposed, among the corners of the second central patch 721.

In one embodiment, the fourth central feed terminal 734 may be formed in the second direction of the second central patch 721. The fourth central feed terminal 734 may be disposed on the opposite side to the second central feed terminal 732 based on the second central patch 721. For example, the fourth central feed terminal 734 may protrude in the Y-axis direction from a corner parallel to a corner at which the second central feed terminal 732 is disposed, among the corners of the second central patch 721.

In one embodiment, the edge feed terminals 740 may include first to fourth edge feed terminals 741 to 744. The edge feed terminals 740 may feed the first side patches 712 and 713 and the second side patches 722 and 723. The edge feed terminals 740 may be formed to be perpendicular to each other in the side patches. For example, the first and second edge feed terminals 741 and 742 may be formed to be perpendicular to each other in the first side patch 712 and the second side patch 722 on one side of the first central patch 711. As another example, the third and fourth edge feed terminals 743 and 744 may be formed to be perpendicular to each other in the first side patch 713 and the second side patch 723 on the other side of the first central patch 711.

In one embodiment, the PCB 220 may further include a feeder that feeds the plurality of first patch antenna elements 711 to 713 and the plurality of second patch antenna elements 721 to 723. The feeder may feed the first central patch 711 and the second central patch 721 using the central feed terminals 730. The feeder may feed the first side patches 712 and 713 and the second side patches 722 and 723 using the edge feed terminals 740.

In one embodiment, the feeder may increase the total amount of feed of the central feed terminals 730. For example, the feeder may respectively connect a first feed port and a second feed port of an RFIC (e.g., the third RFIC 226 of FIG. 2) to horizontal polarization feeders 731 and 733 among the central feed terminals 730 and perform a balanced feed by feeding a normal phase of a signal to the first feed port and feeding an inverse phase of the signal to the second feed port. As another example, the feeder may respectively connect the first feed port and the second feed port of the RFIC to vertical polarization feeders 732 and 734 and perform a balanced feed by feeding a normal phase of a signal to the first feed port and feeding an inverse phase of the signal to the second feed port. The inverse phase of signal may be generated by adding an inverter to a phase shifter included in the RFIC or the RFIC.

In one embodiment, the feeder may increase the total amount of feed by performing feeding with an opposite phase of 180° to the horizontal polarization feeders 731 and 733 or the vertical polarization feeders 732 and 723, which are feeders polarized in the same direction, among the first to fourth central feed terminals 731 to 734. The feeder may supply and transmit twice a power capable of being supplied to one feed port to the first central patch 711 or the second central patch 721, or amplify a received signal with twice a gain capable of being amplified through one feed port by increasing the amount of feed of the first central patch 711 and the second central patch 721 through the balanced feed. Accordingly, the RFIC of the feeder may improve performance of transmission and reception of signals with the plurality of first patch antenna elements 711 to 713 and the plurality of second patch antenna elements 721 to 723.

The values of the ratios related to the antenna structure according to the above description may be set as shown in Table 1 below. Table 1 is a table showing definitions and numerical ranges of terms related to the antenna structure according to an embodiment.

TABLE 1

| Term | Definition | Numerical range |
|---|---|---|
| First ratio | D1/λ1 | About 0.5 to 0.6 |
| Second ratio | D2/λ2 | About 0.5 to 0.6 |
| Third ratio | D3/λ3 | About 0.025 to 0.2 |

In one embodiment, a first ratio, which is a ratio of a first distance D1 to a first wavelength λ1, and a second ratio, which is a ratio of a second distance D2 to a second wavelength λ2 may be in a range of from 0.5 to about 0.6. The first distance D1 may be about 0.5 times to about 0.6 times the first wavelength, which is a wavelength of a signal belonging to the first frequency hand. In addition, the second distance D2 may be a distance of about 0.5 times to about 0.6 times a second wavelength which is a wavelength of a signal belonging to the second frequency band.

In one embodiment, the first ratio that is the ratio of the first distance D1 to the first wavelength λ1 and the second ratio that is the ratio of the second distance D2 to the second wavelength λ2 may be equal to each other. The first distance D1 may be an optimized distance for transmitting or receiving a signal of the first frequency band. The second distance D2 may be an optimized distance for transmitting or receiving a signal of the second frequency band.

More specifically, when a distance between the plurality of first patch antenna elements 311 to 314 and the plurality of second patch antenna elements 321 to 324 is half a wavelength of a signal to be transmitted or received, it may be possible to represent the most desirable performance in terms of isolation between the antenna elements of the signal, a gain, a side lobe, a coverage angle, and a half power beam width. Accordingly, the first distance D1 may be a distance of about 0.5 times to about 0.6 times the first wavelength. In addition, the second distance D2 may be a distance of about 0.5 times to about 0.6 times the second wavelength.

According to one embodiment, the electronic device 101 may transmit or receive a signal of the first frequency band in the most desirable state in terms of coupling, a gain, a grating lobe, a coverage angle, and a half power beam width when a distance between the central points 311*p* to 314*p* of the plurality of first patch antenna elements 311 to 314 is the first distance D1. The electronic device 101 may transmit or receive a signal of the second frequency band in the most desirable state in terms of isolation between the antenna elements, a gain, a side lobe, a coverage angle, and a half power beam width when a distance between the central points 321*p* to 324*p* of the plurality of second patch antenna elements 321 to 324 is the second distance D2 shorter than the first distance D1. Accordingly, the electronic device 101 may transmit or receive signals of the first and second frequency bands in the most desirable state in terms of isolation between all the antenna elements, a gain, a side lobe, a coverage angle, and a half power beam width, using both of the plurality of first patch antenna elements 311 to 314 and the plurality of second patch antenna elements 321 to 324.

In one embodiment, the third ratio, which is a ratio of the third distance D3 to the second wavelength λ2, may be in a range of about 0.025 to about 0.2. The third distance D3 may have a length of about 0.025 times to about 0.2 times the second wavelength λ2. The third distance D3 may be set such that a fringing field formed around the PCB 220 is symmetrical. The electronic device 101 may set the third distance D3 required at the minimum based on the second wavelength λ2, which is a wavelength of a signal of the second frequency band transmitted or received by the second antenna element 321.

In one embodiment, the third distance D3 may be in a range of from about 5% to about 10% of the length of one side of any one second antenna elements 321 of the plurality of second antenna elements 321 to 324. The electronic device 101 may set the third distance D3 based on the length of one side of the second antenna element 321 related to the second size, which is a size of the second antenna element 321.

Figure 8:
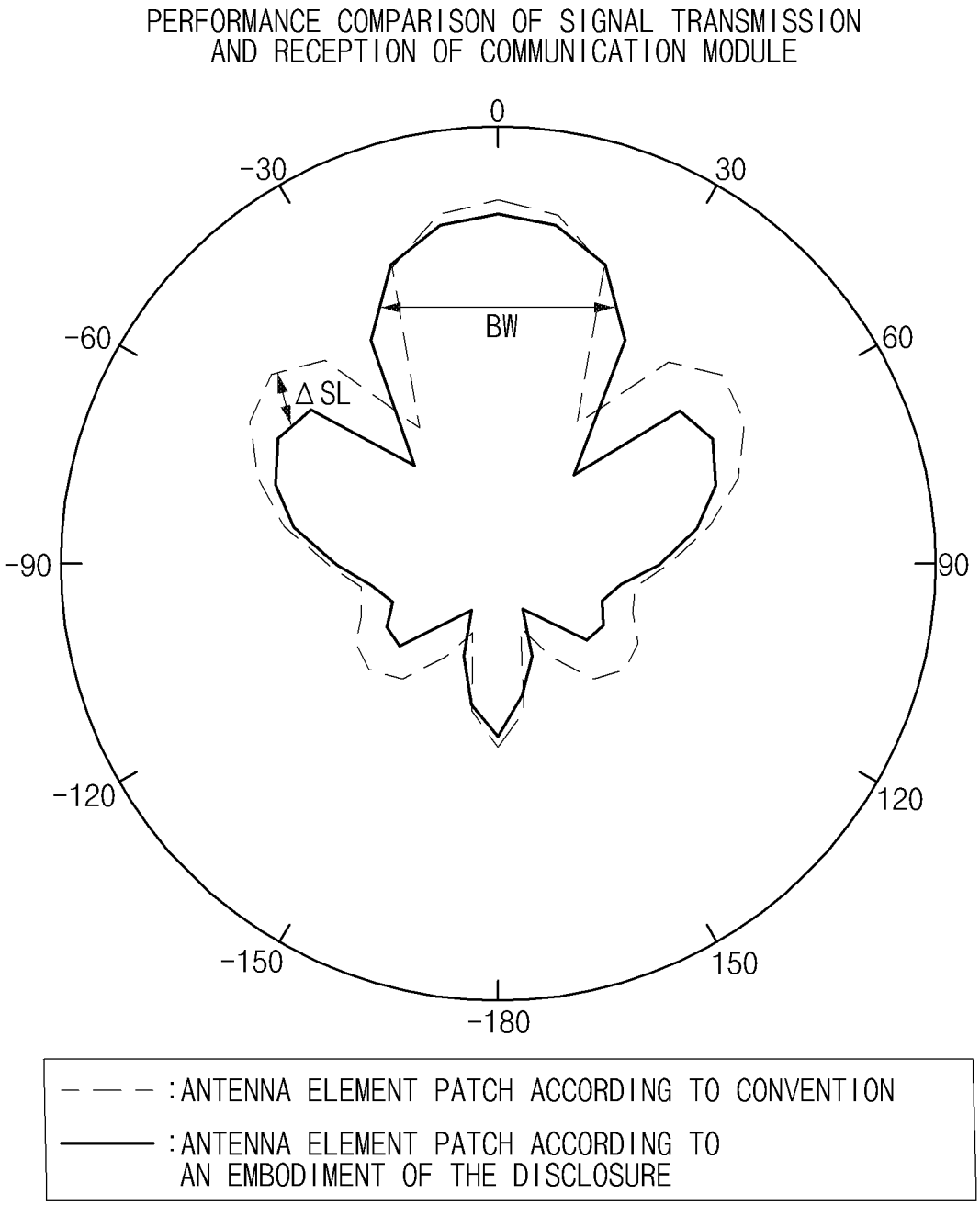
FIG. 8 is a graph comparing transmission and reception performance of communication modules included in antenna structures to which an existing antenna element patch and an antenna element patch of the disclosure according to an embodiment are applied.

FIG. 8 is a polar graph comparing transmission and reception performance of communication modules (e.g., the communication module 190 of FIG. 1) included in antenna structures to which an existing antenna element patch and an antenna element patch of the disclosure according to an embodiment are applied.

In one embodiment, the spacing of the existing antenna elements, for example, the central point of the second antenna element may perpendicularly coincide with the central point of the first antenna element. When the central point of the second antenna element coincides with the central point of the first antenna element and a distance between the second antenna elements is greater than about 0.6 times the wavelength of the second frequency band, the second antenna array may have a relatively narrow beam width in the zero degree direction which is a main direction in which the second antenna array radiates signals. Accordingly, there may occur a problem that the transmission or reception performance of the signal may be lowered as an angle which the beam is able to cover is small when a direction of the beam is tilted during beamforming. In addition, when the existing antenna element patch transmits or receives signals of different frequency bands, side lobes, which are portions radiated in other directions than the main beam, among directional horizontal-patterns of the patch antenna elements may increase. The side lobes may occur in a range of from 30 degrees to 60 degrees on both sides based on the direction of the main beam. Accordingly, it is possible to generate an interference signal in an undesired direction or to receive an interference signal in an undesired direction.

In one embodiment, in the arrangement of the second antenna element of the present disclosure, a distance between the central points 321*p* to 324*p* of the second antenna elements (e.g., the second antenna elements 321 to 324 of FIG. 3) may be shorter than a distance between the central points 311*p* to 314*p* of the first antenna elements (e.g., the first antenna elements 311 to 314 of FIG. 3). When the distance between the second antenna elements is controlled to be in a range of 0.5 times to 0.6 times a wavelength of the second frequency band, a beam width (BW) may be wider than the prior art about the 0 degree direction, which is the main direction in which the second antenna array radiates signals. Accordingly, an angle which the beam is able to cover during beamforming may increase. In addition, when the beam width BW increases, transmission or reception performance degradation of a signal is lowered and may be minimized even when the direction is titled.

In one embodiment, in the arrangement of the second antenna elements of the disclosure, the side lobes generated by the second antenna array may be reduced than the prior art by controlling a distance between the second antenna elements to be in a range of from about 0.5 times to about 0.6 times the wavelength of the second frequency band. As the wavelength versus spacing of the patch antenna elements for transmitting or receiving signals of different frequency bands coincides with each other, the side lobe reduction amount ΔSL may increase. Accordingly, it is possible to minimize losses by reducing the energy of signals radiated in an undesired direction and thereby reduce wasted power consumption.

Figure 9:
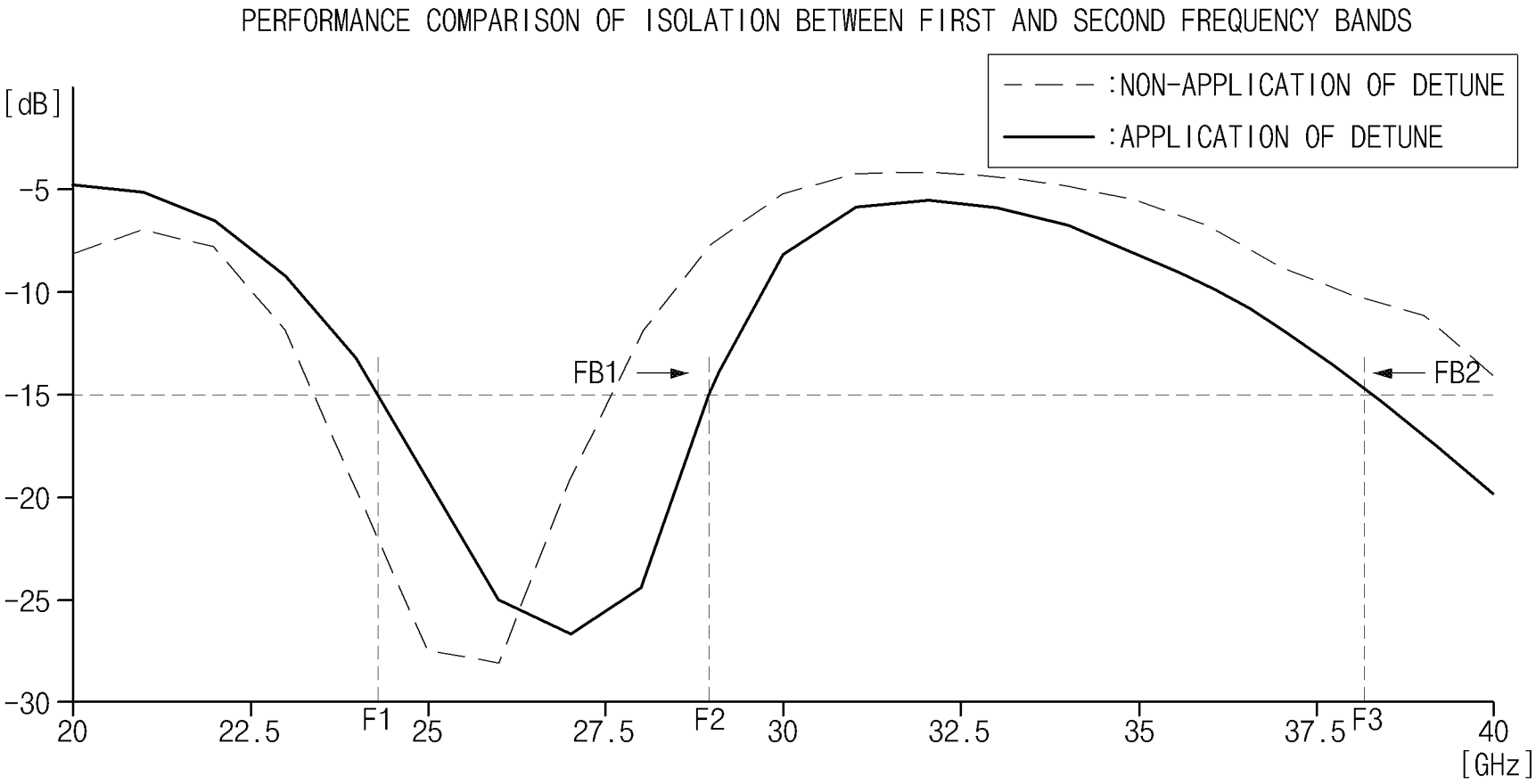
FIG. 9 is a graph comparing isolation performance between first and second frequency bands of antenna structures to which a patch to which no detune is applied and a detune patch according to an embodiment of the disclosure are respectively applied.

FIG. 9 is a graph comparing isolation performance between first and second frequency bands of antenna structures to which a patch to which no detune is applied and a detune patch according to an embodiment of the disclosure are respectively applied.

In one embodiment, the isolation performance may be determined by measuring an S-parameter value between the first patch antenna elements and the second patch antenna elements according to a frequency. To prevent crosstalk between the signal of the first frequency band and the signal of the second frequency band, when the S-parameter value between the first patch antenna elements and the second patch antenna elements has a magnitude of about −15 dB or less, it may be determined that the isolation performance of the first frequency band and the second frequency band satisfies a specified condition.

In one embodiment, a first patch antenna element of the patch to which no detune is applied may transmit and receive a signal of a first center frequency FB1 and a frequency range adjacent to the first center frequency FB1. The second patch antenna element of the patch to which no detune is applied may transmit and receive signals of a second center frequency FB2 and a frequency range adjacent to the second center frequency FB2. However, unnecessary coupling may be caused between a vertical polarization feeder and a horizontal polarization feeder, thereby causing cross pole isolation. This may be a problem caused due to the feeder of the disclosure disposed on an outer portion of the patch antenna.

For example, when the first center frequency FB1 is about 28 GHz and the second center frequency FB2 is about 39 GHz, an existing first patch antenna element and an existing second patch antenna element may be subjected to sifting of the first center frequency FB1 and the second center frequency FB2, and may have an S-parameter value of about −15 dB or less in the frequency range of from about 23 GHz to about 27.5 GHz, and have an S-parameter value of about −15 dB or more in the frequency range of from about 27.5 GHz to about 40 GHz. The frequency range of from about 27.5 GHz to about 40 GHz may include the first center frequency FB1 and the second center frequency FB2. Accordingly, when the first frequency band and the second frequency band fall within a range of from about 27.5 GHz to about 40 GHz, the S-parameter value may be about −15 dB or more, and the isolation performance may not satisfy the specified condition. When the isolation performance does not satisfy the specified condition, coupling may occur between adjacent feed terminals, and cross-pole isolation performance may be degraded between signals of different frequency bands, thereby causing a problem in cross-pole MIMO operation.

In one embodiment, the detune-applied patch of the disclosure may tune a center frequency. For example, a first detune patch (e.g., the first detune patch 611 of FIG. 6) of the detune-applied patch may be about 6% to about 10% smaller than a size of the plurality of first patch antenna elements 311 and 314. The first detune patch may optimally transmit or receive a signal having a frequency of between 1.06f-1.10 f, where f is the resonant frequency of the plurality of first patch antenna elements 311 to 314, so that a resonant frequency of the first detune patch 611 may be about 29 GHz that is tuned to be higher than the first center frequency FB1. As another example, the second detune patch (e.g., the second detune patch 621 of FIG. 6) may be about 4% to about 8% larger than the size of the plurality of second patch antenna elements 321 to 324. The second detune patch 621 may optimally transmit or receive a signal having a frequency of 0.92f-0.96 f compared to the f of the plurality of second patch antenna elements 321 to 324, and thus, the resonant frequency of the second detune patch 621 may be about 37 GHz tuned to be lower than the center frequency of the second frequency band.

According to one embodiment, when the first detune patch and the second detune patch are applied, an S-parameter value of about −15 dB or less may be present in a frequency range of from the first frequency F1 to the second frequency F2. In addition, the S-parameter value of about −15 dB or more may be present in the frequency range of from the second frequency F2 to the third frequency F3, and the S-parameter value of about −15 dB or less may be present in the frequency range of the third frequency (F3) or more.

In one embodiment, the patch of the disclosure may be designed such that the second frequency F2 is equal to or greater than the first center frequency FB1 which is the center frequency of the first frequency band. For example, when the first center frequency FB1 is about 28 GHz, the second frequency F2 of the patch may be designed to be about 29 GHz slightly increased than the first center frequency FB1. In addition, the patch of the disclosure may be designed such that the third frequency F3 is less than or equal to the second center frequency FB2 which is the center frequency of the second frequency band. For example, when the second center frequency FB2 is about 39 GHz, the third frequency F3 of the patch may be designed to be about 38 GHz slightly lowered than the second center frequency FB2.

In one embodiment, the patch of the disclosure may narrow a frequency range between the second frequency F2 and the third frequency F3 than a frequency range between the first center frequency FB1 and the second center frequency FB2. Accordingly, the patch of the disclosure may have an S-parameter value of about −15 dB or less at the first center frequency FB1 and the second center frequency FB2 even in consideration of the coupling phenomenon due to the electric field.

In one embodiment, in the case of having the S-parameter value of about −15 dB or less at the first center frequency FB1 and the second center frequency FB2, isolation performance may satisfy a designated condition in the first frequency band and the second frequency band. When the isolation performance satisfies the specified condition, coupling between adjacent feed terminals may be reduced.

The electronic device according to certain embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that certain embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Certain embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a compiler or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between Where data is semi-permanently stored in the storage medium and where the data is temporarily stored in the storage medium.

According to an embodiment, a method according to certain embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to certain embodiments, each component (e.g., a module or a program) of the above-described components may include a single entity or multiple entities. According to certain embodiments, one or more of the above-described components may be omitted, or one or more other components may be added. Alternatively or additionally, a plurality of components (e.g., modules or programs) may be integrated into a single component. In such a case, according to certain embodiments, the integrated component may still perform one or more functions of each of the plurality of components in the same or similar manner as they are performed by a corresponding one of the plurality of components before the integration. According to certain embodiments, operations performed by the module, the program, or another component may be carried out sequentially, in parallel, repeatedly, or heuristically, or one or more of the operations may be executed in a different order or omitted, or one or more other operations may be added.

According to the embodiments disclosed in the disclosure, it is possible to increase the width of a beam to be transmitted and received in a high frequency band in which small patch antenna elements perform transmission and reception and reduce side lobes radiated in a direction other than the main beam of the directional horizontal-patterns of the patch antenna element.

In addition, according to the embodiments disclosed in the disclosure, an unnecessary electric field may not occur, and the isolation characteristics of isolating signals of different frequency bands may be improved, thereby preventing the cross pole isolation.

In addition, various effects may be provided that are directly or indirectly understood through the disclosure.

While the disclosure has been shown and described with reference to certain embodiments thereof, it will be understood by those skilled in the art that various changes in form and details may be made therein without departing from the spirit and scope of the disclosure as defined by the appended claims and their equivalents.

What is claimed is:

1. An electronic device comprising:

a Printed Circuit Board (PCB) including a first circuit board plane including a plurality of first patch antenna elements and a second circuit board plane including a plurality of second patch antenna elements;

a communication module configured to transmit and receive a signal of a first frequency band using the plurality of first patch antenna elements, and transmit and receive a signal of a second frequency band higher than the first frequency band using the plurality of second patch antenna elements; and a processor connected to the communication module, wherein each of the plurality of first patch antenna elements are overlapped with each of the plurality of second patch antenna elements when viewed from above the PCB, wherein central points of the plurality of first patch antenna elements are spaced apart from one another to have a first distance and central points of the plurality of second patch antenna elements are spaced apart from one another to have a second distance shorter than the first distance, wherein the plurality of second patch antenna elements are arranged such that the central points of the plurality of second patch antenna elements are disposed to be closer to a central axis connecting a first central point that is a center of gravity of the first circuit board plane and a second central point that is a center of gravity of the second circuit board plane in a direction passing through the printed circuit board from a first surface to a second surface of the printed circuit board, than the central points of the plurality of first patch antenna elements; and wherein the plurality of first patch antenna elements is disposed below the second circuit board plane, such that edges of the plurality of first patch antenna elements surround each one of the plurality of second patch antenna elements when viewed from above.

2. The electronic device of claim 1, wherein the first distance is a length related to a first wavelength of the first frequency band and the second distance is a length related to a second wavelength of the second frequency band.

3. The electronic device of claim 2, wherein a ratio of the first distance to the first wavelength and a ratio of the second distance to the second wavelength are in a range of 0.5 to 0.6.

4. The electronic device of claim 1, wherein edges of the plurality of second patch antenna elements are closer than edges of the plurality of first patch antenna elements to a center point of the plurality of first patch antenna elements.

5. The electronic device of claim 4, wherein a distance between an edge of a particular one of the plurality of first patch antenna elements and an edge of a particular one of the plurality of second patch antenna elements is a third distance, the third distance having a ratio to a second wavelength in a range of from 0.025 to 0.2.

6. The electronic device of claim 1, wherein the PCB further includes a first detune patch in which a size of at least some of the plurality of first patch antenna elements is adjusted and a second detune patch in which a size of at least some of the plurality of second patch antenna elements is adjusted, wherein the first detune patch has a size 6% to 10% smaller than the size of the plurality of first patch antenna elements, and wherein the second detune patch has a size 4% to 8% smaller than the size of the plurality of second patch antenna elements.

7. The electronic device of claim 1, further comprising:

a feeder configured to feed the plurality of first patch antenna elements and the plurality of second patch antenna elements, Wherein the feeder includes a feed layer disposed on a lowermost layer of the PCB;

a ground layer disposed on the feed layer;

a feeding coupler formed between the first circuit board plane and the second circuit board plane; and a connector configured to connect the feeding coupler and the feed layer, wherein the connector passes through the first circuit board plane.

8. The electronic device of claim 7, further comprising:

a first insulating layer disposed between the first circuit board plane and the feed layer; and a second insulating layer disposed between the first circuit board plane and the second circuit board plane, wherein the connector passes through the first insulating layer and the second insulating layer, and wherein the feeding coupler passes through at least a part of the second insulating layer.

9. The electronic device of claim 1, further comprising:

a first feed terminal configured to transmit and receive a polarized in a first direction; and a second feed terminal configured to transmit and receive a signal polarized in a second direction perpendicular to the first direction, wherein the first feed terminal and the second feed terminal are perpendicular to each other.

10. An antenna structure comprising:

a Printed Circuit Board (PCB), wherein the PCB includes a first circuit board plane including a plurality of first patch antenna elements formed to have a first size enabling transmission and reception of a signal of a first frequency band; and a second circuit board plane including a plurality of second patch antenna elements formed to have a second size enabling transmission and reception of a signal of a second frequency band, wherein the plurality of first patch antenna elements are disposed such that central points of the plurality of first patch antenna elements are spaced apart from one another by a first distance related to a first wavelength of the first frequency band and the plurality of second patch antenna elements are disposed such that central points of the plurality of second patch antenna elements are spaced apart from one another by a second distance related to a second wavelength of the second frequency band, wherein the plurality of first patch antenna elements is disposed below the second circuit board plane, such that edges of the plurality of first patch antenna elements surround each one of the plurality of second patch antenna elements when viewed from above, and wherein each of the plurality of first patch antenna elements are overlapped with each of the plurality of second patch antenna elements when viewed from above the PCB.

11. The antenna structure of claim 10, wherein the first distance is longer than the second distance.

12. The antenna structure of claim 10, wherein a ratio of the first distance to the first wavelength and a ratio of the second distance to the second wavelength are equal to each other.

13. The antenna structure of claim 10, wherein any one of the plurality of first patch antenna elements has a first edge, wherein a second patch antenna element that overlaps the any one of the plurality of first patch antenna elements has a second edge, and wherein the second edge is closer to a central point of the any one of the plurality of first patch antenna elements than the first edge.

14. The antenna structure of claim 13, wherein a distance between the first edge and the second edge is a third distance, and wherein the third distance is in a range of from 5% to 10% of a length of one side of any one of the plurality of second patch antenna elements.

15. The antenna structure of claim 10, wherein the PCB further includes a first detune patch in which a size of at least some of the plurality of first patch antenna elements is adjusted and a second detune patch in which a size of at least some of the plurality of second patch antenna elements is adjusted, wherein the first detune patch is between 6% to 10% smaller than the first size, and wherein the second detune patch is between 4% to 8% smaller than the second size.

16. An electronic device comprising:

a Printed Circuit Board (PCB) including a first circuit board plane including a plurality of first patch antenna elements and a second circuit board plane including a plurality of second patch antenna elements;

a communication module configured to transmit and receive a signal of a first frequency band using the plurality of first patch antenna elements, and transmit and receive a signal of a second frequency band using the plurality of second patch antenna elements; and a processor connected to the communication module, wherein the plurality of first patch antenna elements include a first central patch disposed on a central axis of the PCB and first side patches spaced apart from each other on both sides of the first central patch, wherein the plurality of second patch antenna elements include a second central patch disposed on a central axis of the PCB and second side patches spaced apart from each other on both sides of the second central patch, and wherein the second side patches are arranged to be closer to the central axis connecting a first central point that is a center of gravity of the first circuit board plane and a second central point that is a center of gravity of the second circuit board plane in a direction passing through the printed circuit board from a first surface to a second surface of the printed circuit board, than central points of the first side patches, and the first central patch and the second central patch are fed using central feed terminals formed in different directions.

17. The electronic device of claim 16, wherein the first central patch and the first side patches are spaced apart from each other by a first distance related to a first wavelength of the first frequency band and the second central patch and the second side patches are spaced apart from each other by a second distance related to a second wavelength of the second frequency band, and wherein the first distance is longer than the second distance.

18. The electronic device of claim 17, wherein a ratio of the first distance to the first wavelength and a second ratio that is a ratio of the second distance to the second wavelength are in a range of 0.5 to 0.6.

19. The electronic device of claim 16, wherein the central feed terminals include a first central feed terminal formed in a first direction of the second central patch, a second central feed terminal formed in a second direction perpendicular to the first direction of the second central patch, a third central feed terminal disposed on an opposite side of the first central feed terminal based on the second central patch, and a fourth central feed terminal disposed on an opposite side of the second central feed terminal based on the second central patch.

20. The electronic device of claim 16, further comprising:

a feeder configured to feed the plurality of first patch antenna elements and the plurality of second patch antenna elements, wherein the feeder performs balanced feeding by increasing a total amount of feed for the central feed terminals and performing feeding.

* * * * *